US007036442B2

(12) United States Patent
Miyamoto et al.

(10) Patent No.: US 7,036,442 B2
(45) Date of Patent: May 2, 2006

(54) YARN PASSING DEVICE OF SEWING MACHINE FOR EMBROIDERY

(75) Inventors: Toshio Miyamoto, Sakurai (JP); Teruya Miyamoto, Sakurai (JP)

(73) Assignee: Miyamoto Kabushiki Kaisha, Nara (JP)

( * ) Notice: Subject to any disclaimer, the term of this patent is extended or adjusted under 35 U.S.C. 154(b) by 389 days.

(21) Appl. No.: 10/220,704

(22) PCT Filed: Mar. 7, 2001

(86) PCT No.: PCT/JP01/01763

§ 371 (c)(1),
(2), (4) Date: Sep. 5, 2002

(87) PCT Pub. No.: WO01/66847

PCT Pub. Date: Sep. 13, 2001

(65) Prior Publication Data

US 2003/0024452 A1 Feb. 6, 2003

(30) Foreign Application Priority Data

| | | |
|---|---|---|
| Mar. 7, 2000 | (JP) | 2000-061510 |
| Mar. 7, 2000 | (JP) | 2000-062074 |
| Jul. 28, 2000 | (JP) | 2000-228131 |
| Jul. 28, 2000 | (JP) | 2000-228266 |
| Jul. 28, 2000 | (JP) | 2000-228275 |
| Sep. 1, 2000 | (JP) | 2000-264807 |

(51) Int. Cl.
*D05B 87/02* (2006.01)

(52) U.S. Cl. ..... 112/225

(58) Field of Classification Search ..... 112/222, 112/224, 225, 78, 80.07, 80.4; 223/99
See application file for complete search history.

(56) References Cited

U.S. PATENT DOCUMENTS

| | | | | | |
|---|---|---|---|---|---|
| 1,008,731 | A | * | 11/1911 | Rogers | 112/225 |
| 1,059,641 | A | * | 4/1913 | Scranton | 112/225 |
| 3,502,045 | A | * | 3/1970 | Hanyu | 112/225 |
| 4,651,660 | A | * | 3/1987 | Oshima et al. | 112/225 |
| 5,097,775 | A | | 3/1992 | Ogawa et al. | |
| 5,596,940 | A | * | 1/1997 | Yamada et al. | 112/225 |
| 6,067,919 | A | * | 5/2000 | Shoji | 112/225 |
| 6,701,858 | B1 | * | 3/2004 | Wacker | 112/225 |

FOREIGN PATENT DOCUMENTS

| | | |
|---|---|---|
| JP | 60-32476 | 7/1985 |
| JP | 62-151878 | 9/1987 |
| JP | 2-21835 | 5/1990 |
| JP | 3-126483 | 5/1991 |
| JP | 3-141986 | 6/1991 |
| WO | 98/04769 | 2/1998 |

* cited by examiner

*Primary Examiner*—Ismael Izaguirre
(74) *Attorney, Agent, or Firm*—Wenderoth, Lind & Ponack, L.L.P.

(57) ABSTRACT

A threading device for embroidery machinery performs threading accurately regardless of the type of thread such that it is capable of changing colored thread automatically without intervention of an operator. The threading device includes a needle support mechanism disposed movably facing a hooking member, for preventing deflection of a needle by correcting deflection of the needle, when inserting the hooking member formed in the shape of a hook at a tip of a thread pull-out mechanism in a needle hole.

17 Claims, 41 Drawing Sheets

YARN PASSING DEVICE OF SEWING MACHINE FOR EMBROIDERY

TECHNICAL FIELD

The present invention relates to a threading device for embroidery machinery, and more specifically to a threading device for embroidery machinery realized in such a way that it performs the processing for change of colored thread (hereinafter also called simply "thread" or "needle thread", depending on the case), etc. automatically without intervention of an operator.

BACKGROUND ART

In the past, the processing for change of colored thread, etc. used to be performed with manual work of an operator.

By the way, in a processing for change of colored thread, etc., the sewing machine must be stopped, and, especially in the case of a change of colored thread, it is necessary to change the colored thread on each of the sewing machine heads provided in the number of several pieces to as many as 30 pieces in some cases on a single embroidery machine. This stopping time could last for several hours, presenting a problem of drop of operating rate and productivity of the sewing machine.

In view of the problem of the conventional embroidery machinery, this inventor previously proposed embroidery machinery capable of performing the processing for change of colored thread without intervention of an operator (see PCT/JP97/02601 and PCT/JP97/02602).

This embroidery machinery, which can automatically perform the processing for change of colored thread without intervention of an operator, could shorten the time required for such operation and, therefore, had an advantage of the possibility of improving the operating rate and productivity of the sewing machine.

However, this sewing machine had a problem of somewhat low accuracy of threading.

SUMMARY OF THE INVENTION

In view of the problems with the embroidery machinery, the objective of the present invention is to provide a threading device for embroidery machinery, realized in such a way that it accurately performs threading regardless of the thread type, for embroidery machinery, etc., capable of performing the process of changing of colored thread automatically without the intervention of an operator, for example.

To achieve the objective, the threading device for embroidery machinery according to the present invention is characterized in that it is provided with a needle supporting mechanism, disposed movably facing the hooking member, to prevent deflection of the needle, by correcting needle deflection, when inserting the hooking member formed in the shape of a hook at the tip of the thread pull-out mechanism in the needle hole.

Here, "facing the hooking member" does not necessarily require the needle position be in the axial direction.

According to this threading device for embroidery machinery, the threading mechanism which is comprised of a thread pull-out mechanism provided with a needle support mechanism formed in the shape of a hook at the tip, the thread pull-out mechanism being disposed movably facing the hooking member to prevent deflection of the needle by correcting the needle deflection, when inserting the hooking member in the needle hole, it becomes possible to pass the thread end, led to a position close to the needle by being gripped with a thread gripping member, through the needle hole by hooking the needle by means of a hooking member formed in the shape of a hook at the tip. It also becomes possible to prevent deflection of the needle when inserting the hooking member in the needle hole, so insertion of the hooking member in the needle hole and threading can be performed smoothly and accurately.

For that reason, by applying this threading device for embroidery machinery to an embroidery machine capable of performing the process of changing thread colors, etc. without intervention of an operator, for example, it becomes possible to shorten the time required for changing thread, thereby improving the operating rate and productivity of the sewing machine.

In such cases, the needle support mechanism may be constructed in such a way that it supports the needle by swinging about in a horizontal plane from the standby position, or constructed in such a way as to support the needle by swinging about in a vertical plane from a standby position.

This increases freedom of the needle support mechanism design and makes it possible to accurately prevent the needle support mechanism from coming in contact with the thread tensioning mechanism and other accessory mechanisms of the embroidery machine, thus securing smooth drive of the respective mechanisms.

It should be noted that, by constructing the needle support mechanism in such a way that it supports the needle by swinging about in a vertical plane from the standby position, it becomes possible to reduce the width of the needle support mechanism and thus realize a compact structure for embroidery machinery, including the needle support mechanism.

Moreover, it also becomes possible to form the tip of the needle support member of the needle support mechanism supporting the needle in a V shape. This enables accurate correction deflection of the needle with a simple mechanism, preventing needle deflection.

Furthermore, in case of thread breakage, it is possible to insert the hooking member of the thread pull-out mechanism in the needle hole of the needle supported by the needle support mechanism, by driving the drive mechanism of the thread pull-out mechanism and the drive mechanism of the needle support mechanism of the sewing machine head where the thread is broken, make the needle support mechanism return to its standby position, by driving the drive mechanism of the needle support mechanism, and then have the needle pull-out mechanism retreat to perform threading, by driving the drive mechanism of the needle pull-out mechanism, in the state in which the thread is stretched on the hooking member of the needle pull-out mechanism. It is further possible to automatically perform the actions of inserting the hooking member of the thread pull-out mechanism in the needle hole of the needle supported by the needle support mechanism, by driving, at least minimally, the drive mechanism of the thread pull-out mechanism and the drive mechanism of the needle support mechanism of the sewing machine head where the thread is broken, making the needle support member return to its standby position, by driving the drive mechanism of the needle support mechanism, and remaining on standby in that state.

This makes it possible to smoothly continue processing in case of thread breakage in either manual work or semi-automatic operation, by using the drive mechanism of the thread pull-out mechanism and the drive mechanism of the needle support mechanism, further improving the operating rate and productivity of the sewing machine.

In addition, to achieve the same objective, the threading device for embroidery machinery according to the present invention is characterized in that the needle support mechanism, for positioning the needle in a prescribed position by correcting needle deflection, when inserting the hooking member formed in the shape of a hook at the tip of the thread pull-out mechanism in the needle hole, is disposed movably at a position above the hooking member.

By using this threading device for embroidery machinery, the threading mechanism of which comprised of a thread pull-out mechanism provided with a needle support mechanism formed in the shape of a hook at the tip and in which a needle bar support mechanism for correcting deflection in the direction of the needle bar height when inserting this hooking member in the needle hole is disposed movably to a position above the hooking member, it becomes possible to correct deflection in the direction of needle bar height and pass the end of the thread, led to a position close to the needle by being gripped by a thread gripping member, in the needle hole through the needle bar, by hooking the needle by means of a hooking member formed in the shape of a hook at the tip. It also becomes possible to prevent deflection of the needle when inserting the hooking member in the needle hole, allowing smooth insertion of the hooking member into the needle hole and accurate threading.

In such a case, the needle support member of the needle bar support mechanism may be formed in a V shape like a fork at the tip, in such a way that it grips the needle and the guide provided in projection in a horizontal direction on the needle bar at the same time, or formed in such a way as to fit the guide provided in projection on the needle bar.

This enables accurate deflection correction of the needle bar with a simple mechanism.

Also, the needle bar support mechanism may be constructed in such a way that it can be driven in synchronization with the drive mechanism of the needle support mechanism. This enables the user to sharply shorten the working time for thread change, etc., thereby improving the operating rate and productivity of the sewing machine.

Moreover, it is also possible to dispose a guide piece on both sides of the hooking member of the thread pull-out mechanism, and to form a projection on at least one of the guide pieces. This makes it possible to easily stretch the thread held in fingers when manually performing processing in case of thread breakage, horizontally on the hooking member of the thread pull-out mechanism, and thus accurately perform manual threading.

Furthermore, to achieve the same objective, the threading device for embroidery machinery according to the present invention is a threading device for embroidery machinery including a thread tensioning mechanism, provided with a thread gripping member for gripping the thread hanging from the thread feed tube at its end, for leading the thread gripped by that thread gripping member to a position close to the needle and placing the stretched thread on a balancing mechanism, and a threading mechanism for guiding the thread into the needle hole, characterized in that the threading mechanism is comprised of a thread pull-out mechanism, provided with a needle support mechanism formed in the shape of a hook at the tip, and a thread stretching mechanism, movably mounted on the thread gripping member for stretching the thread gripped in the thread gripping member at its end horizontally on the hooking member, in the space formed with the thread gripping member.

By using this threading device for embroidery machinery, it becomes possible to perform the process for changing of colored thread, etc. automatically without the intervention of an operator, and shorten the time required for such an operation, thereby improving the operating rate and productivity of the sewing machine.

Note that, because the threading mechanism is comprised of a thread pull-out mechanism provided with a needle support mechanism formed in the shape of a hook at the tip and a thread stretching mechanism movably mounted on the thread gripping member for stretching the thread gripped by the thread gripping member at its end horizontally on the hooking member in the space formed with the thread gripping member, it is possible to accurately pass the end of the thread, led to a position close to the needle by being gripped by a thread gripping members, through the needle hole by hooking the needle by means of a hooking member formed in the shape of a hook at the tip.

In this case, the thread stretching mechanism may be constructed in such a way as to stretch the thread gripped by the thread gripping member at its end horizontally, in the space formed with the thread gripping member, by moving in a horizontal direction in the space formed with the thread tensioning mechanism while getting to a position close to the needle, following the thread gripping mechanism of the thread tensioning mechanism. This makes it possible to stretch the thread gripped by the thread gripping member at its end horizontally on the hooking member of the thread pull-out mechanism automatically and accurately, with a simple mechanism.

Furthermore, the drive mechanism of the thread tensioning mechanism may be constructed in such a way that the moving speed of the thread gripping member moving from the thread feed tube to a position close to the needle may move slowly at the thread feed tube and a position close to the needle, but fast at the intermediate position between them. This enables quick movement of the thread gripping member from the thread feed tube to a position close to the needle, without any influences on the thread gripping of threading process, thus shortening the time required for the processing of changing thread colored.

In addition, the needle support mechanism for preventing deflection of the needle by correcting needle deflection when inserting the hooking member in the needle hole may be mounted movably facing the hooking member. This makes it possible to prevent deflection when inserting the hooking member in the needle hole, and smoothly inserts the hooking member into the needle hole to more accurately perform threading.

Moreover, the drive mechanism of the needle tensioning mechanism and/or the drive mechanism of the thread pull-out mechanism and the needle support mechanism may be constructed in a way that they are driven independently at each sewing machine head of the embroidery machinery. This makes it possible to automatically perform all processing steps relating to the thread, including processing in case of breakage, further improving the operating rate and productivity of the sewing machine.

Furthermore, it is also possible to dispose a guide piece on both sides of the hooking member of the thread pull-out mechanism, forming a projection for temporarily fastening the thread on at least one of the guide pieces. This makes it possible to easily stretch the thread held in the operator's fingers, when manually performing a process in case of thread breakage, horizontally on the hooking member of the thread pull-out mechanism, and thus accurately perform manual threading.

DETAILED DESCRIPTION OF THE INVENTION

An embodiment of the threading device for embroidery machinery according to the present invention will be described in detail below, with reference to drawings.

Figure 1:
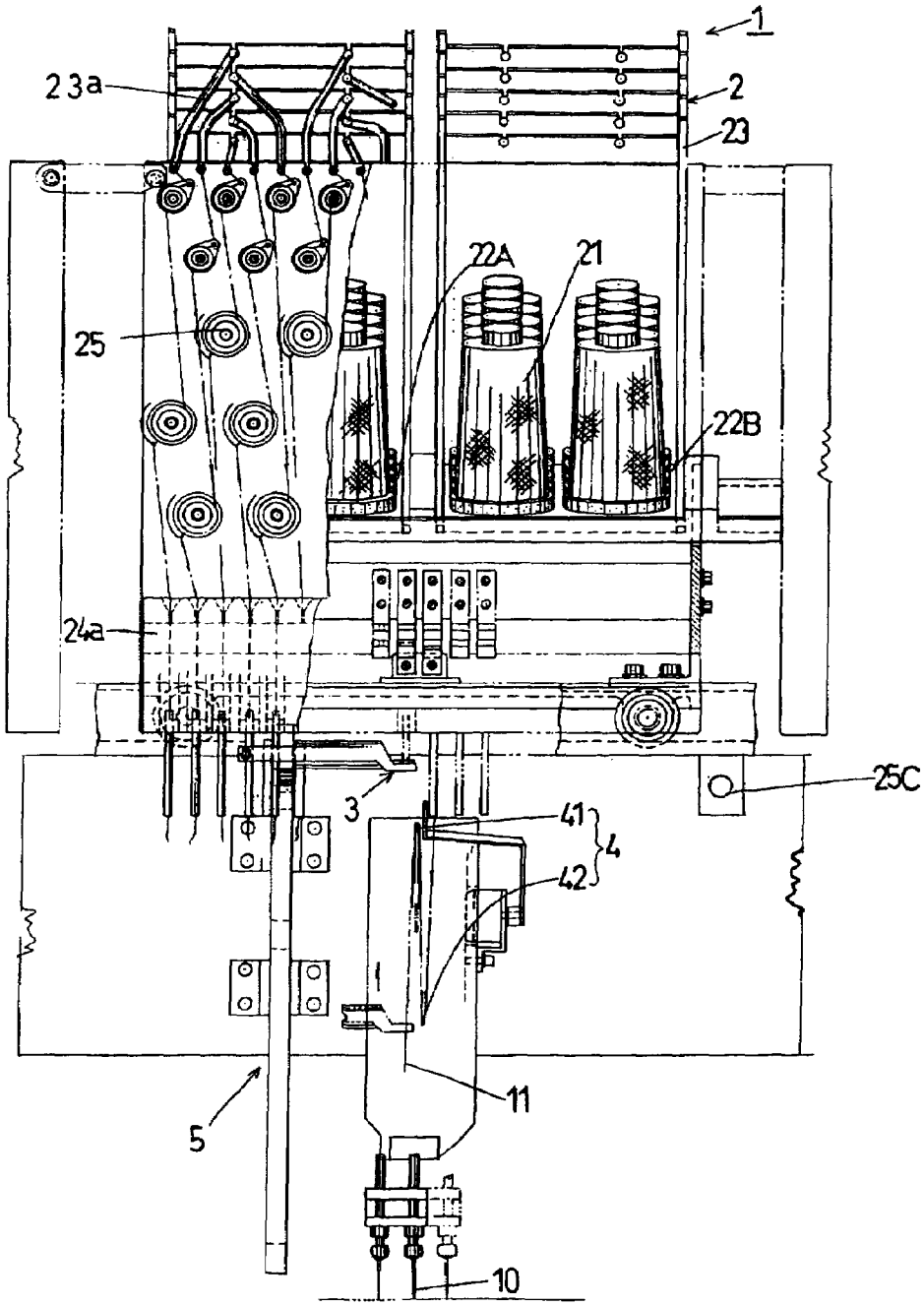
FIG. 1 is a general front elevation showing an embodiment of the embroidery machine according to the present invention.
Figure 2:
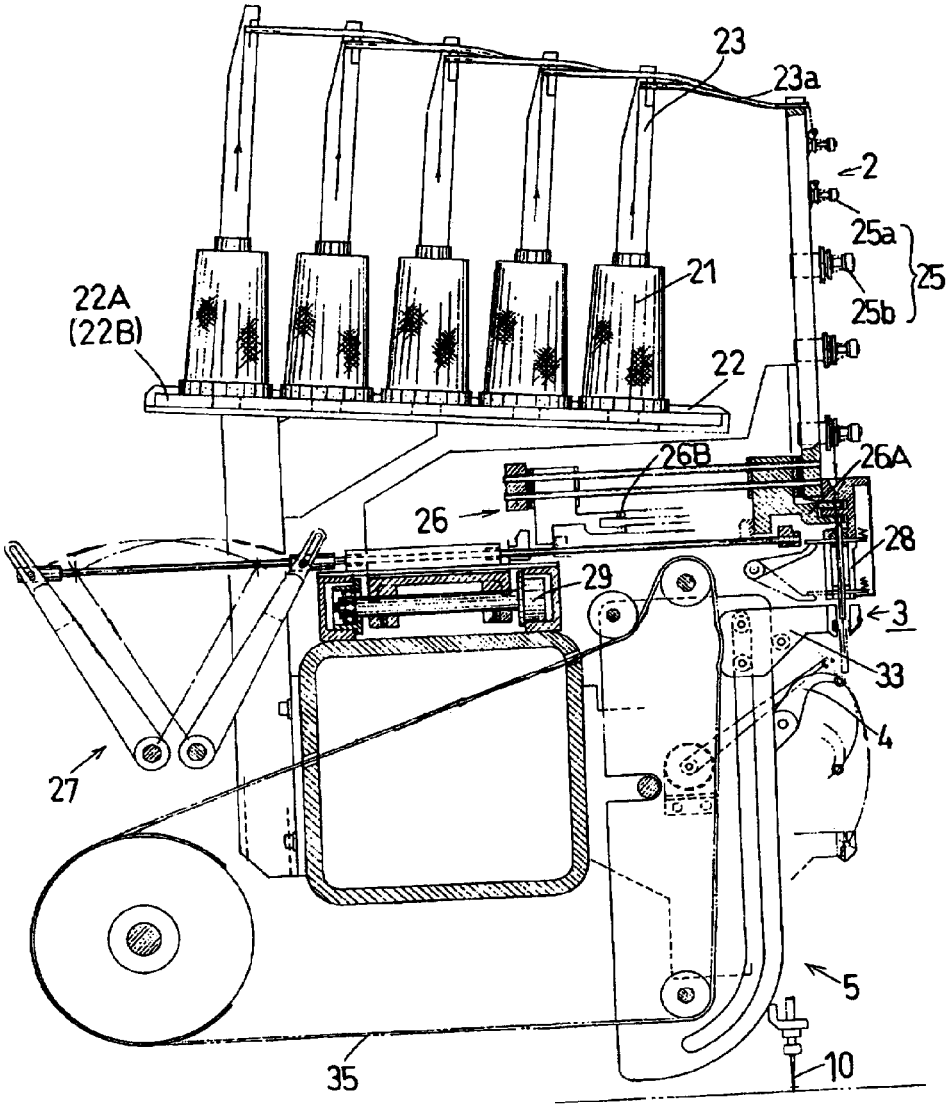
FIG. 2 is a side view of the embroidery machine.
Figure 3:
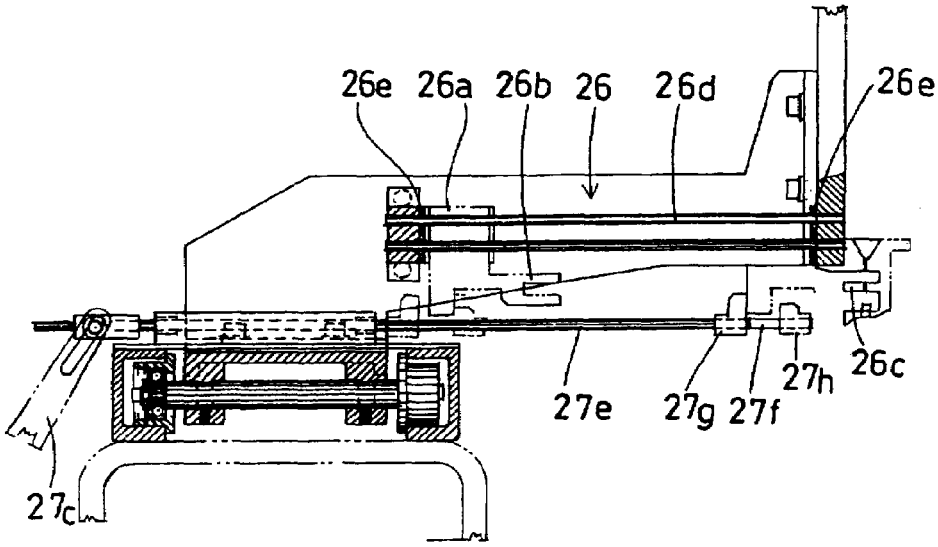
FIGS. 3(A) and 3(B) indicate the thread length regulating mechanism, (A) being a side sectional view, and (B) a plan view.
Figure 3:
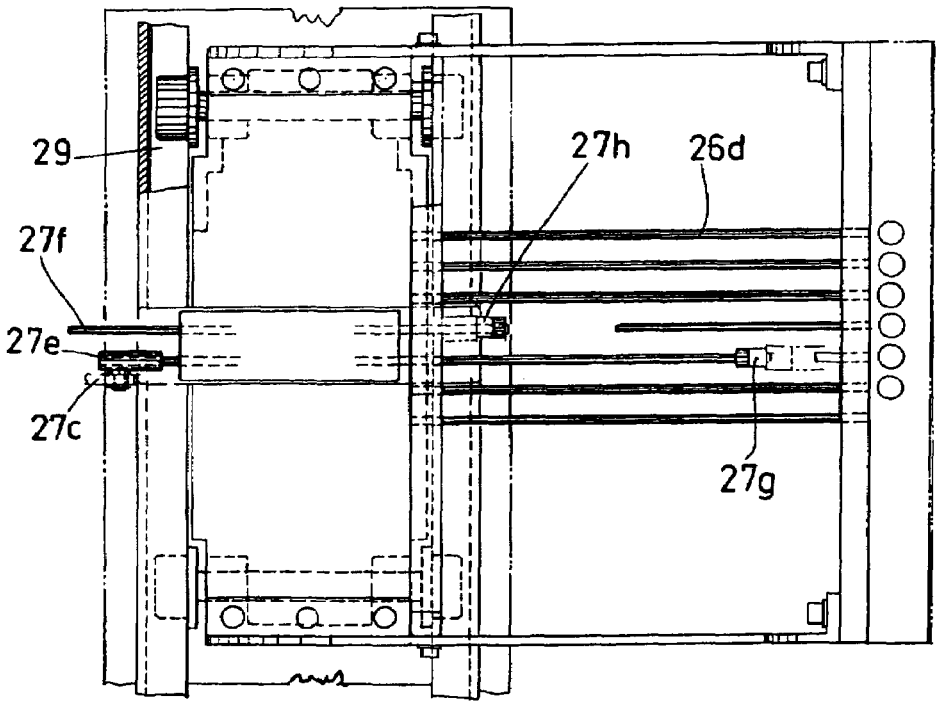
Figure 4:
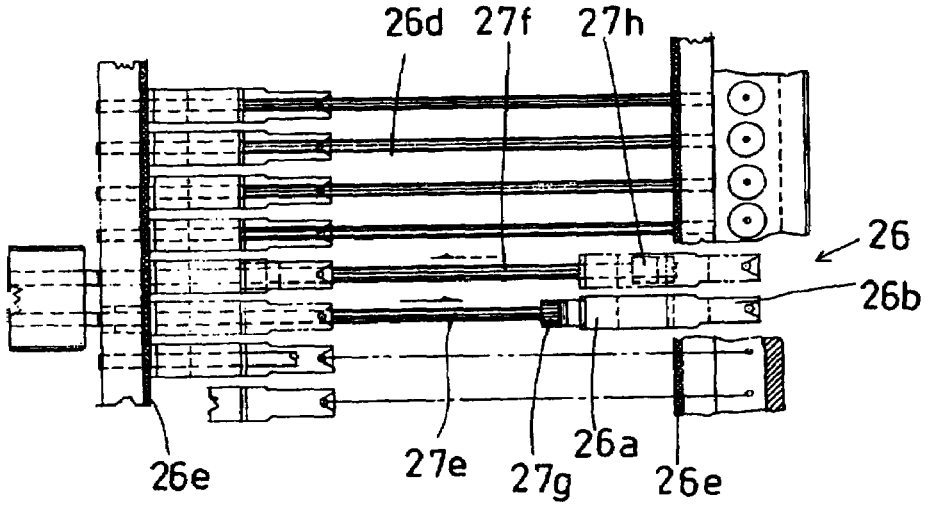
FIGS. 4(A) and 4(B) indicate the main part of the thread length regulating mechanism, (A) being a plan view, and (B) a side sectional view.
Figure 4:
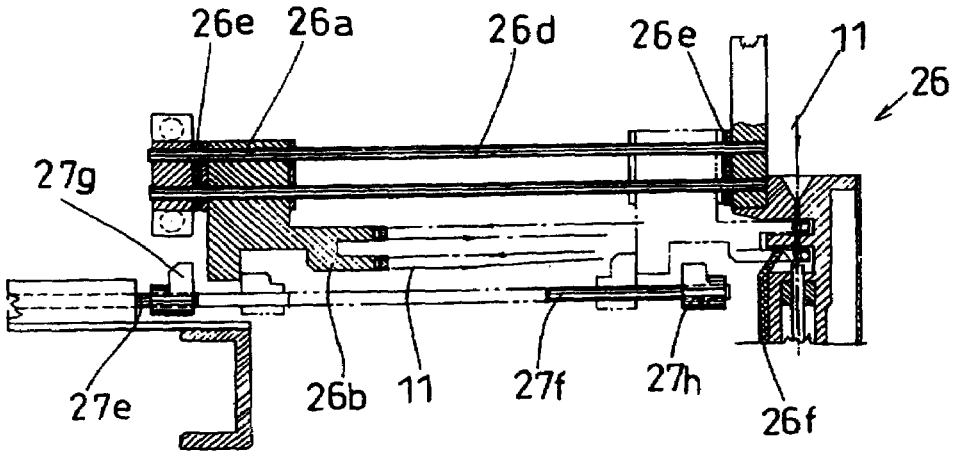
Figure 5:
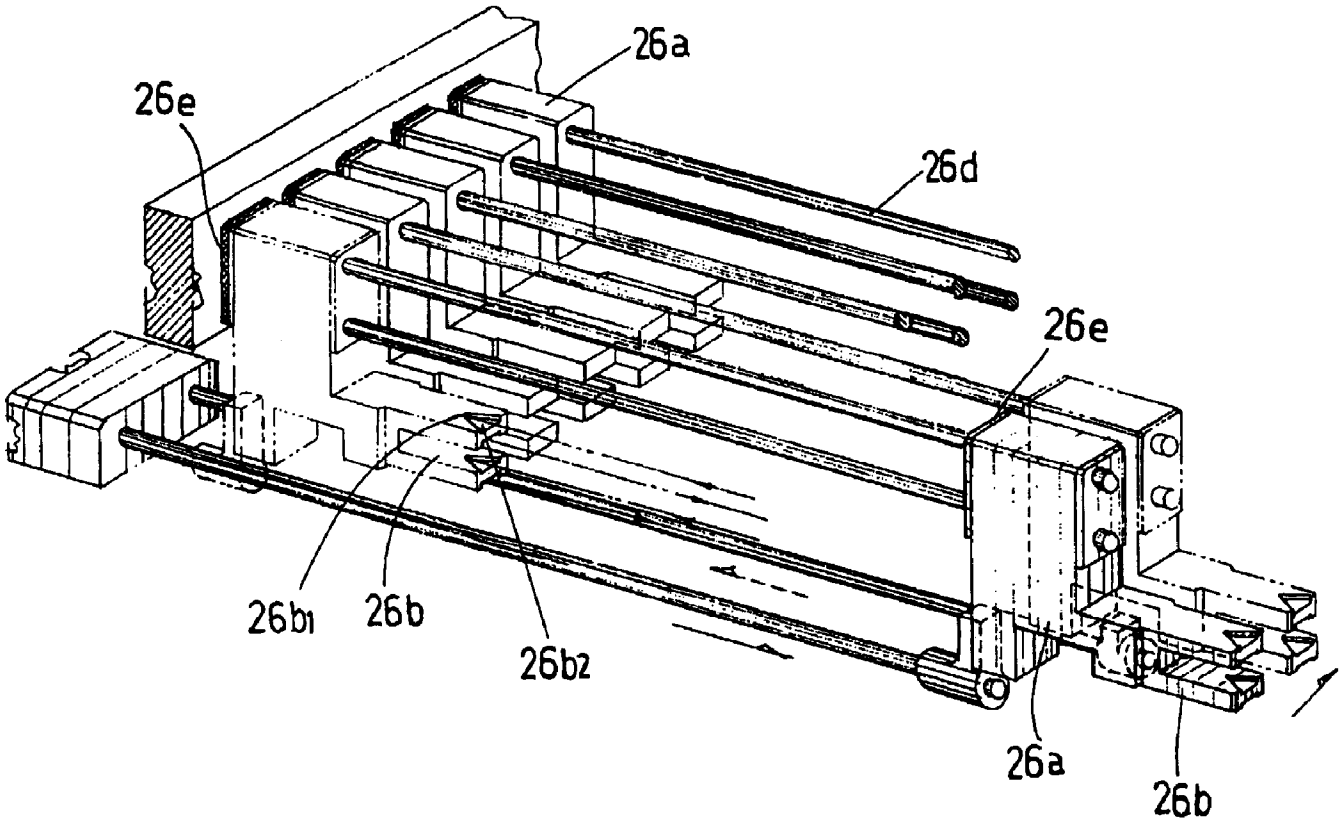
FIG. 5 is a perspective view of the thread length adjusting mechanism.
Figure 6:
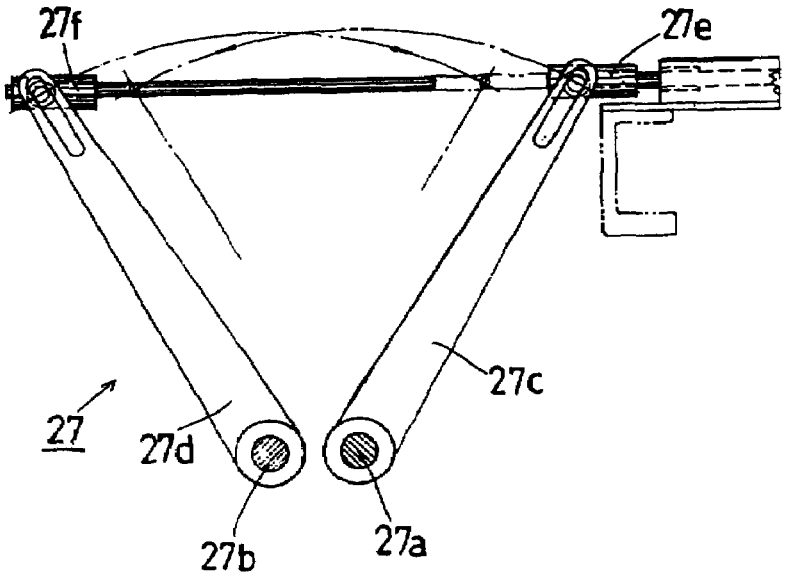
FIGS. 6(A) and 6(B) indicate the slide member drive mechanism of the thread length regulating mechanism, (A) being a side view, and (B) a plan view.
Figure 6:
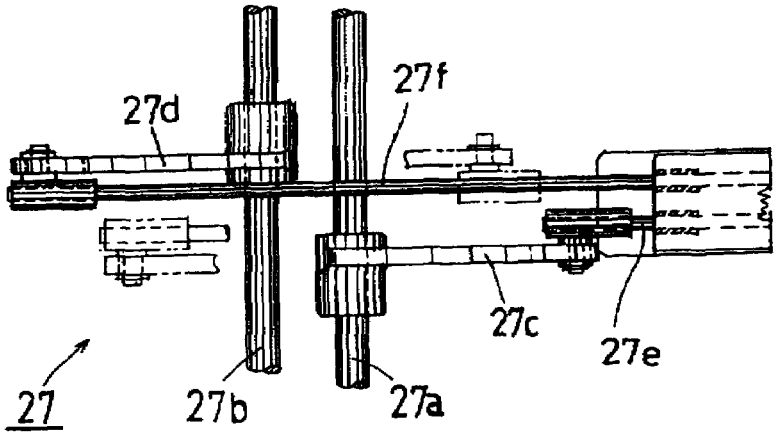

As shown in FIG. 1~FIG. 2, the main part of an embroidery machine is composed of a plurality of sewing machine heads 1, thread feed & recovery devices 2, a balancing mechanism 4, a threading device 5, etc.

This drawing of the embodiment exemplifies part of the sewing machine heads provided in the number of several pieces to as many as 30 pieces in some cases on a single embroidery machine. And, the same construction as that of the illustrated embodiment is employed for the other sewing machine heads, and the respective sewing machine heads are designed to be driven simultaneously by common drive sources of various types. If necessary, a clutch may be interposed between the common drive source and the respective sewing machine heads, or an independent drive source may be provided for each of the sewing machine heads, to enable the driving of the respective sewing machine heads independently of one another, but those mechanisms are basically no different from those of the conventional embroidery machinery.

Moreover, all of the thread feed & recovery devices 2, threading device 5, etc. provided on the sewing machine heads of the embroidery machine in this embodiment shall preferably be provided, but part of the devices may be replaced by other mechanisms having similar functions or simply omitted, as the case may be.

Furthermore, while, in this embodiment, drive sources, such as an electric motor, air cylinder, solenoid, etc., are used as drive sources of various kinds of drive mechanisms, some drive sources may also be employed selectively as required, though not particularly mentioned on each occasion.

Still more, while, in this embodiment, the connection between various kinds of drive mechanisms and drive sources is made by means of connecting mechanisms, such as link mechanism, lever mechanism, wire mechanism, etc., these connecting mechanisms may be replaced by other proper connecting mechanisms as required, though not particularly mentioned on each occasion.

Yet more, in this embodiment, as an air source used for feeding the thread to the needle, a pump mechanism may be used which can send out air through extension and contraction of a bellow type air chamber, for example, in addition to an air compressor.

FIG. 1~FIG. 8(B) indicate an embodiment of the thread feed & recovery device 2 provided at the top of the sewing machine heads 1 of the embroidery machine.

This thread feed & recovery device 2 is composed of a bobbin housing 22 accommodating a plurality of bobbins 21 of colored thread, thread tension regulating mechanisms 25 provided in correspondence to the number of pieces of the bobbins 21 accommodated in this bobbin housing 22, a thread regulating mechanism 24 comprising a thread length regulating mechanism 26 and a thread feed mechanism 28, for holding thread 11 sent out toward a needle 10 at prescribed length and recovering and holding the thread 11 sent out toward the needle 10, and a thread selecting mechanism 29 for selectively positioning the thread feed mechanism 28 corresponding to the required bobbin 21 above the threading device 5 which performs threading on the required needle 10.

Figure 9:
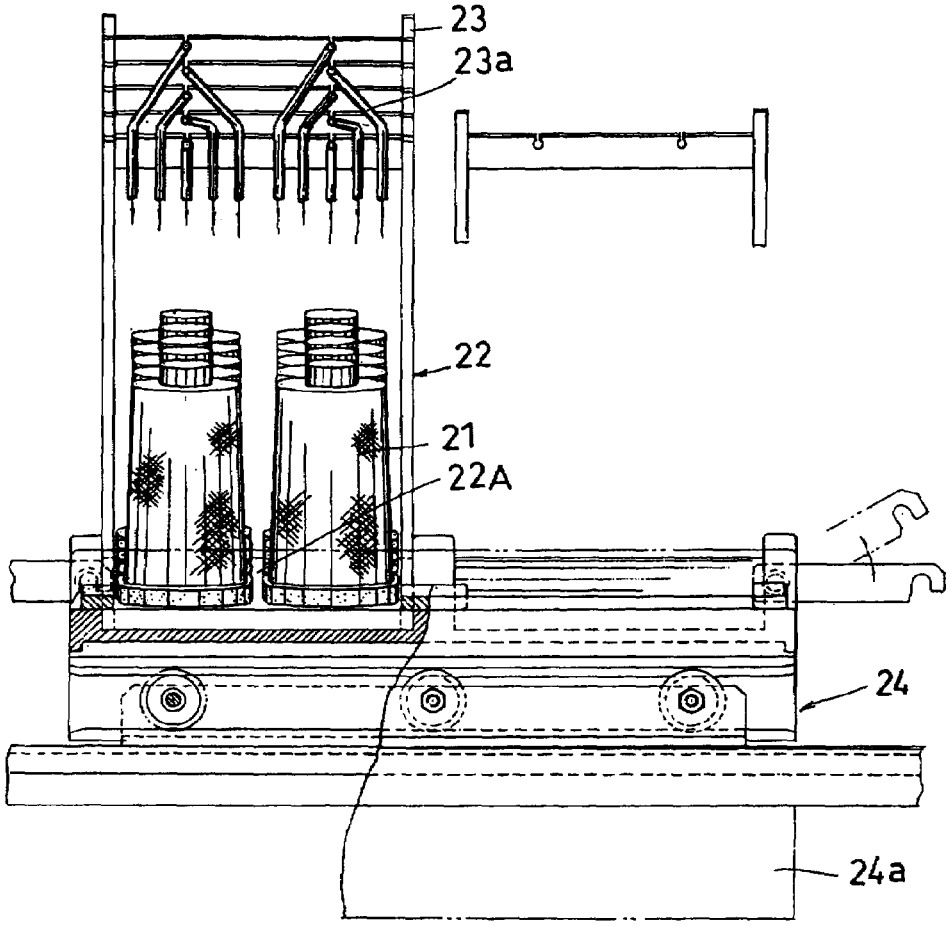
FIG. 9 is a front elevation showing a modified example of the bobbin housing.
Figure 10:
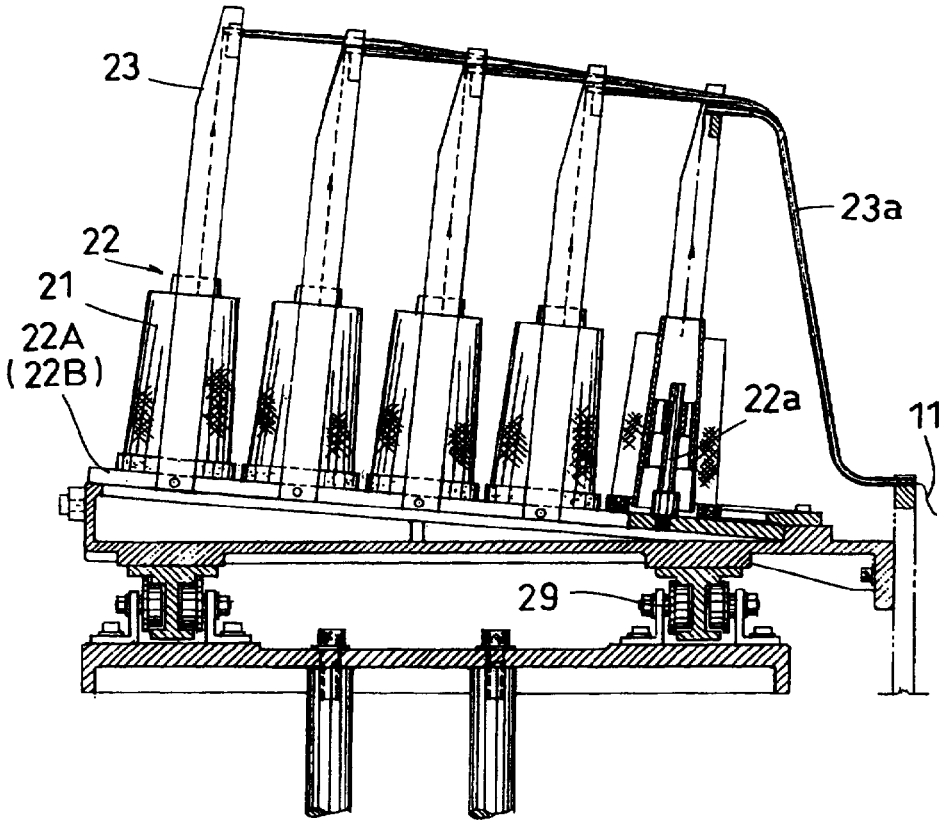
FIG. 10 is a side view of the bobbin housing.

And, while, in this embodiment, the bobbin housing 22 is constructed in a unit and detachably mounted on the sewing machine head 1, it may be fixed to the sewing machine head 1, as required, or may also be constructed in a way to slide integrally with the thread regulating mechanism 24, the thread feed mechanism 28, etc. which are made to slide by the thread selecting mechanism 29, as in the modified embodiment indicated in FIG. 9~FIG. 10.

The bobbin housing 22 is realized, for example, in a way to accommodate a total number of 20 bobbins 21 by loading, on each sewing machine head 1, 2 bobbin housing units 22A, 22B each of which can accommodate 10 bobbins 21, and the bobbin housing units 22A, 22B are provided, at the bottom face, with a spindle 22*a* in upright position for inserting and supporting the bobbins 21, while a thread holder 23 for pulling out the threads 11 from the respective bobbins 21 without entanglement is provided in fixed position above a main body 24*a* of the thread regulating mechanism 24, so as to pull out a total number of 20 threads 11 from the thread holder 23 by securing a free space among them and feeding them into the thread tension regulating mechanisms 25 of the thread regulating mechanism 24.

And, to pull out the threads 11 from the respective bobbins 21 without entanglement, duct lines 23*a* made of transparent synthetic resin pipe may be disposed from the thread holder 23 up to a position above the main body 24*a* of the thread regulating mechanism 24, to pass the threads 11 one by one through those duct lines 23*a*.

The thread tension regulating mechanisms 25 have 2 thread tension regulating members 25*a*, 25*b* for each of the threads 11 from the respective bobbins 21, provided on the outer circumferential face of the main body 24*a* of the thread regulating mechanism 24.

On one of the thread tension regulating members 25*b* is disposed a tension sensor (not illustrated) for measuring the tension of the threads 11, so that breakage, etc. of the threads 11 may be detected.

The signal from this tension sensor is sent, as electric signal, from an electric contact (not illustrated) disposed in the thread regulating mechanism 24 to the control unit of the embroidery machine, through an electric circuit (not illustrated) provided with an electric contact disposed in the sewing machine head 1, to control the drive of the embroidery machine and notify the operator of breakage of the threads 11 by lighting the indicating lamp (not illustrated), indicating the state of upper thread and lower thread, disposed on the sewing machine head 1, etc.

In addition to the indicating lamps, at proper positions of the embroidery machine may be provided a display unit, such as liquid crystal display board, etc. and alarm device such as buzzer, etc., for indicating the state of the embroidery machine to the operator.

The thread length regulating mechanism 26 provided below the thread tension regulating mechanism 25 is intended to hold the threads 11 sent out toward the needle 10 at prescribed length or, to be concrete, at a length by which the threads 11 of a length required for starting embroidery work are inserted in the needle 10, when the tip of the threads 111 is guided to a position close to the needle 10 by the threading device 5, and to recover and hold the threads 11 sent out toward the needle 10. This thread length regulating mechanism 26 is constructed in a way to form a thread inserter 26*b* at the tip of a sliding member 26*a* sliding along 2 pieces each of guide member 26*d* provided about in horizontal position, selectively make slide a plurality of sliding members 26*a* with a drive mechanism 27 of the sliding members 26*a*, and selectively position the thread inserter 26*b* formed at the tip of the sliding members 26*a* at the thread feed position 26A and holding position 26B.

This drive mechanism 27 of the sliding members 26*a* of the thread length regulating mechanism 26 is composed of levers 27*c*, 27*d* provided on common drive shafts 27*a*, 27*b* disposed in a way to range over a plurality of sewing machine heads 1, sliding rods 27*e*, 27*f* driven by those levers 27*c*, 27*d*, a pushing member 27*g* of the sliding member 26*a* and a pulling member 27*h* of the sliding member 26*a* disposed at the tip of the sliding rods 27*e*, 27*f* respectively, as shown in FIG. 2~FIG. 7, to thereby enable replacement of colored thread on each of the sewing machine heads 1 provided in the number of several pieces to as many as 30 pieces in some cases on a single embroidery machine.

In this case, the drive shaft 27*a*, the lever 27*c*, the sliding rod 27*e* and the pushing member 27*g* are intended to move the thread inserter 26*b* formed at the tip of the sliding members 26*a* from the thread holding position 26B to the feed position 26A, while, on the other hand, the drive shaft 27*b*, the lever 27*d*, the sliding rod 27*f* and the pulling member 27*h* are used for moving the thread inserter 26*b* formed at the tip of the sliding members 26*a* from the feed position 26A to the thread holding position 26B.

The drive mechanism 27 of the sliding members 26*a* of the thread length regulating mechanism 26 may be constructed in a way to be driven independently for each sewing machine head 1 of the embroidery machine, by interposing a proper clutch mechanism (not illustrated) such as key, etc. driven by optional drive sources, such as an electromagnetic clutch, solenoid, motor, air cylinder, etc., to thereby enable processing relating to all threads 11, including processing in case of breakage of threads 11, and further improve the operating rate and productivity of the sewing machine.

Figure 7:
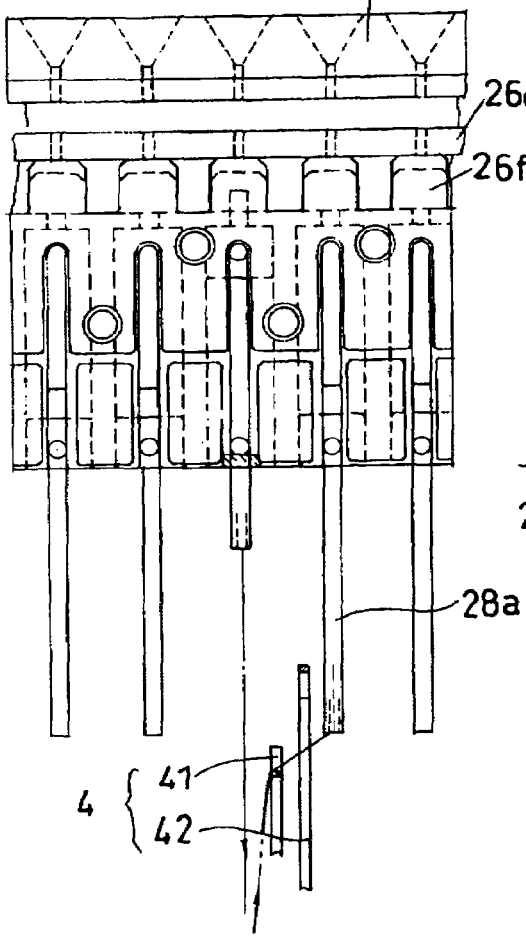
FIGS. 7(A) and 7(B) indicate the thread feed mechanism, (A) being a plan view, and (B) a side sectional view.
Figure 7:
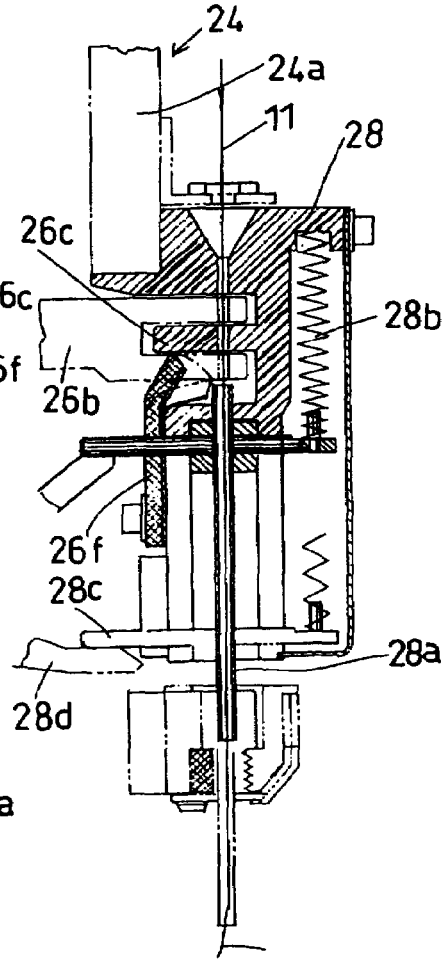

And, the embroidery machine of this embodiment is so designed as to move a thread feed pipe 28*a* sideways by a step (right side facing the front face of the sewing machine head 1) in the state where the threads 11 are placed on it, by driving the thread selecting mechanism 29 of the thread feeder 2, as shown in FIG. 1 and FIG. 7, to perform embroidery. Therefore, the respective members of the drive mechanism 27 are also disposed at the same interval as the disposing pitch of sliding members 26*a* in the direction of breadth of the sewing machine heads 1.

As described above, a drive shaft 27*a* provided with a lever 27*c*, etc. for moving the thread inserter 26*b* from the thread holding position 26B to the feed position 26A, and moving a drive shaft 27*b* provided with a lever 27*d*, etc. for moving the thread inserter 26*b* from the feed position 26A to the thread holding position 26B are provided separately, to make it possible to first recover the threads 11, by moving the adjacent 2 sliding members 26*a*, 26*a* individually in opposite directions, usually, by means of the lever 27*c* and the lever 27*d*, etc., and then feed the threads 11. Moreover, by moving the two about simultaneously in opposite directions, as required, it becomes possible to perform feed and recovery of the threads 11 almost simultaneously, as required, and remarkably shorten the time required for the replacement of colored threads.

Furthermore, since the sliding members 26*a* of the thread length regulating mechanism 26 are designed to slide along the guide member 26*d* provided about in horizontal position, the position of the sliding members 26*a* forming the thread inserter 26*b* does not change, and this makes it possible to accurately hold the sliding members 26*a* forming the thread inserter 26*b* at prescribed position, and thus improve the driving stability of the device.

In this case, magnets 26*e*, 26*e* for adsorbing and holding the sliding member 26*a* at prescribed position on the front and rear sides may be disposed to make it possible to hold the sliding members 26*a* forming the thread inserter 26*b* more accurately at the prescribed position. And, in adaptation to those magnets 26*e*, 26*e*, a member adsorbed to the magnet 26*e* is pasted on the face to be in contact with the magnet 26*e* of the sliding member 26*a*. The magnet holding the sliding members 26*a* forming the thread inserter 26*b* at prescribed position may be provided on the sliding member 26*a* side as well.

The thread inserter 26*b* disposed at the tip of the sliding members 26*a* of the thread length regulating mechanism 26 is formed in about U shape, though not particularly restricted to it, to be capable of holding the thread 11 of a length by which the threads 11 of a length required for starting embroidery work are inserted in the needle 10, when the tip of the threads 11 is guided to a position close to the needle 10 by the threading device 5, and placing the threads 11 in 2 round trips in the space formed with the thread inserter 26*c* disposed on the main body 24*a* side of the thread regulating mechanism 24 in about E shape.

In this case, at least a surface 26*b*2 of thread inserter 26*b* to be inserted in a thread inserter 26*c* is depressed to the position of a thread inserting hole 26*b*1, to thereby prevent the threads 11 from being gripped and cut off between the thread inserters 26*b*, 26*c*.

Still more, in the thread inserter 26*c* disposed on the main body 24*a* side of the thread regulating mechanism 24 is disposed a thread holding member 26*f* such as felt, etc. provided with an elastic member such as a sheet spring, etc. on the back face, to hold the threads 11 placed in the space formed with the thread inserter 26*b* loose. This makes it possible to prevent the threads 11, inserted in the thread feed mechanism 28 after being placed between the thread inserters 26*b*, 26*c*, from falling off inadvertently from the thread feed mechanism 28, and prevent the threads 11 from loosening, when recovering the threads 11 sent out toward the needle 10 into the thread length regulating mechanism 26.

The thread feed mechanism 28 provided at the bottom of the main body 24*a* side of the thread regulating mechanism 24, below the thread length regulating mechanism 26, is intended to prevent mutual entanglement of adjacent threads 11 for sending out the threads smoothly toward the needle 10, and comprises, as shown in FIGS. 7(A) and (B), the thread feed tube 28*a* disposed in a way to move up and down for leading the threads 11 to the threading device 5, a compression spring 28*b* provided as required for urging the thread feed tube 28*a* in the downward direction, an operating piece 28*c* of the thread feed tube 28*a*, an operating lever 28*d* of the operating piece 28*c*, and a drive mechanism 28*e* of the operating lever 28*d*.

In this case, the thread feed tube 28*a* is designed to be positioned, when it is down, between the mobile gripping piece 31*a* and the fixed gripping piece 31*b* of the thread gripping member 31 in the thread tensioning mechanism 3 of the threading device 5, so that, by driving a drive mechanism 28*e* of the operating lever 28*d* in that state, it may become possible to operate the operating piece 28*c* of the thread feed tube 28*a* with the operating lever 28*d*, to make the thread feed tube 28*a* go up against the urging force of the compression spring 28*b* and expose the threads 11, and to hold the threads 11 accurately with a mobile gripping piece 31*a* and a fixed gripping piece 31*b* of the thread gripping member 31 in the thread tensioning mechanism 3.

The thread selecting mechanism 29, intended for selectively positioning the thread feed tube 28*a* of the thread feed mechanism 28 corresponding to the required bobbin 21 above the threading device 5 for passing the threads 11 in the required needle 10, is arranged, in this embodiment, in a way to perform replacement of colored threads simultaneously for each of the sewing machine heads 1 provided in the number of several pieces to as many as 30 pieces in some cases on a single embroidery machine, by sliding the thread regulating mechanism 24.

In this case, the thread selecting mechanism 29 is designed to be controlled by the control unit of the embroidery machine, to make it possible to select a large number of colored threads automatically, by making the control unit memorize in advance the type (color) of the respective bobbins 21 housed in the bobbin housing 22.

Yet more, while the thread tension regulating mechanisms 25, the thread length regulating mechanism 26 and the thread feed mechanism 28 constituting the thread regulating mechanism 24 are provided in correspondence to the number of bobbins 21 which can be housed in the bobbin housing 22 respectively, namely in 20 sets in this embodiment, on the main body 24*a* of the thread regulating mechanism 24, the drive mechanism 27 of the sliding member 26*a* is provided in the number of one piece on the sewing machine head 1 side, to be used in a way to operate the one which is in prescribed position or work with the one which is in the prescribed position of those 20 sets of mechanisms, namely used commonly for those 20 sets of mechanisms.

Moreover, in the case where the bobbin housing units 22A, 22B are detachably mounted on the sewing machine head 1, the bobbin housing units 22A, 22B shall, preferably, be provided in a plural number of multiples of the number of the sewing machine heads 1. This makes it possible, when replacing the colored threads, to shorten the time required for the change of colored threads by replacing the bobbin housing units 22A, 22B as a whole. For example, if the bobbin housing units 22A, 22B of this embodiment are provided in twice the number of the sewing machine heads 1, replacement of colored threads of 40 different colors maximum can be made in a short time. In that case, by having the control unit of the embroidery machine memorize in advance the type (color) of the respective bobbins 21 housed in the bobbin housing 22, it becomes possible to replace a large number of colored threads automatically, by simply replacing the bobbin housing units 22A, 22B.

Furthermore, while, in this embodiment, the thread regulating mechanism 24 is arranged to be made to slide by the thread selecting mechanism 29, to selectively position the thread feed tube 28*a* of the thread feed mechanism 28 corresponding to the required bobbin 21 above the threading device 5 for passing the threads 11 in the required needle 10, it is also possible to adopt a mechanism for swingably driving the thread regulating mechanism 24 with its spindle as the axis of oscillation, as the thread selecting mechanism.

Figure 8:
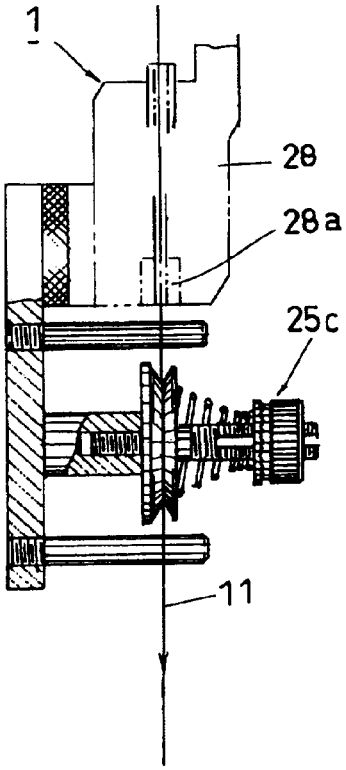
FIGS. 8(A) and 8(B) indicate the thread tension controlling device, (A) being a plan view, and (B) a side view.
Figure 8:
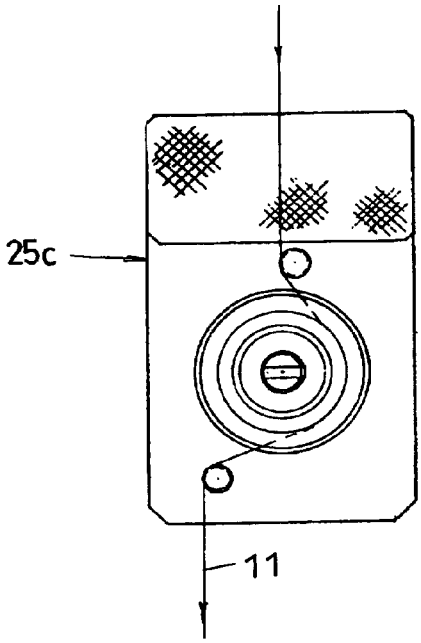

Still more, on the sewing machine head 1 near the main body 24*a* of the thread regulating mechanism 24 is disposed a thread tension regulating device 25*c* for adjusting the strength of tension of the threads 11 applied by 2 thread tension regulating members 25*a*, 25*b*, as shown in FIG. 8.

This thread tension regulating device 25*c*, which can apply to the threads 11 a tension equal to the tension exerted on the threads 11, through the balancing mechanism 4 composed of a balance 41 and an auxiliary balance 42, the needle 10, etc. located below the thread feed & recovery device 2 to be described later, makes it possible to uniformly regulate the strength of tension of the threads 11 from the respective bobbins 21 applied by the two thread tension regulating members 25*a*, 25*b*, without placing the threads 11 on the balance 41, the auxiliary balance 42, the needle 10, etc. And, this thread tension regulating device 25*c* has a magnet at its base, so that it may be selectively and detachably installed at a proper position on the sewing machine head 1 or, to be more concrete, at a position between the thread feed tube 28*a* of the thread feed mechanism 28 provided for sending out the threads 11 from the respective bobbins 21 toward the needle 10.

Below the thread feed & recovery device 2 of the sewing machine head 1 is disposed the threading device 5 composed of a thread tensioning mechanism 3 and a threading mechanism 6, as shown in FIGS. 11(A)~FIG. 27(B).

The thread tensioning mechanism 3, for guiding the end of the threads 11 hanging from the thread feed tube 28*a* of the thread feeder 2 to a position close to the needle 10, is composed of a thread gripping member 31, a lever 32 provided at the tip with the thread gripping member 31, a sliding piece 33 supporting the bottom end of the lever 32, a guide groove 34 of the sliding piece 33 disposed about in up-down direction on the main body of the thread tensioning mechanism 30, a belt 35 for lifting the sliding piece 33 along the guide groove 34, and a drive mechanism 36 for driving the belt 35.

As described above, by constructing the thread tensioning mechanism 3 with the lever 32, the lifting sliding piece 33, etc., it becomes possible to realize the thread tensioning mechanism 3 in compact size, and especially reduce the amount of projection on front side of the sewing machine head 1 of the thread gripping member 31.

This thread tensioning mechanism 3 is provided with a shoe member 31*e* swingably operated by a drive mechanism 1*a* such as rotary solenoid, etc. disposed on the sewing machine head 1, to make it possible for the thread gripping member 31 to grip the end the threads 11 hanging from the thread feed tube 28*a*, when moving the thread gripping member 31 from the standby position at about the middle part (right under the lowest position of the auxiliary balance 42 of the balancing mechanism 4 to be described later) to the highest position where to grip the end part of the threads 11 hanging from the thread feed tube 28*a*, by driving the belt 35 with the drive mechanism 36. And it is so arranged that the contact member 31*f* disposed at the tip of the operating piece 31*d* protruding from the mobile gripping piece 31*a* of the thread gripping member 31 contacts with this shoe member 31*e*, to open the mobile gripping piece 31*a* against the urging force of the spring member 31*c* and position the thread feed tube 28*a* between the mobile gripping piece 31*a* and the fixed gripping piece 31*b*.

And, the thread tensioning mechanism 3 is constructed in such a way as to operate the operating piece 28*c* of the thread feed tube 28*a* with the operating lever 28*d* of the thread feed mechanism 28, by driving the drive mechanism 28*e* of the operating lever 28*d* in that state, to make the thread feed tube 28*a* go up against the urging force of the compression spring 28*b* and expose the threads 11, then swing the shoe member 31*e* with a drive mechanism 1*a* such as rotary solenoid, etc. to cancel the contact between the shoe member 31*e* and the contact member 31*f*, and restore the mobile gripping piece 31*a* and grip the threads 11 inserted between the mobile gripping piece 31*a* and the fixed gripping piece 31*b*.

And, it is constructed by disposing a shoe member 31*g* swingably operated by a drive mechanism 1*a* such as rotary solenoid, etc. through a connecting rod 1*b*, to make it possible to move, by driving the belt 35 in that state, the thread gripping member 31 from the highest position to the lowest position of its stroke, to guide the threads 11 led to a position close to the needle 10 to the needle hole 10*a* for threading, and then release the end of the threads 11 which have been gripped by the thread gripping member 31, so as to press the contact member 31*f* disposed at the tip of the operating piece 31*d* protruding from the mobile gripping piece 31*a* of the thread gripping member 31, with this shoe member 31*g*, to open the mobile gripping piece 31*a* against the urging force of the spring member 31*c*.

After that, the thread gripping member 31 is made to move, by driving the belt 35, to the standby position at about the middle part, to remain on standby.

Figure 15:
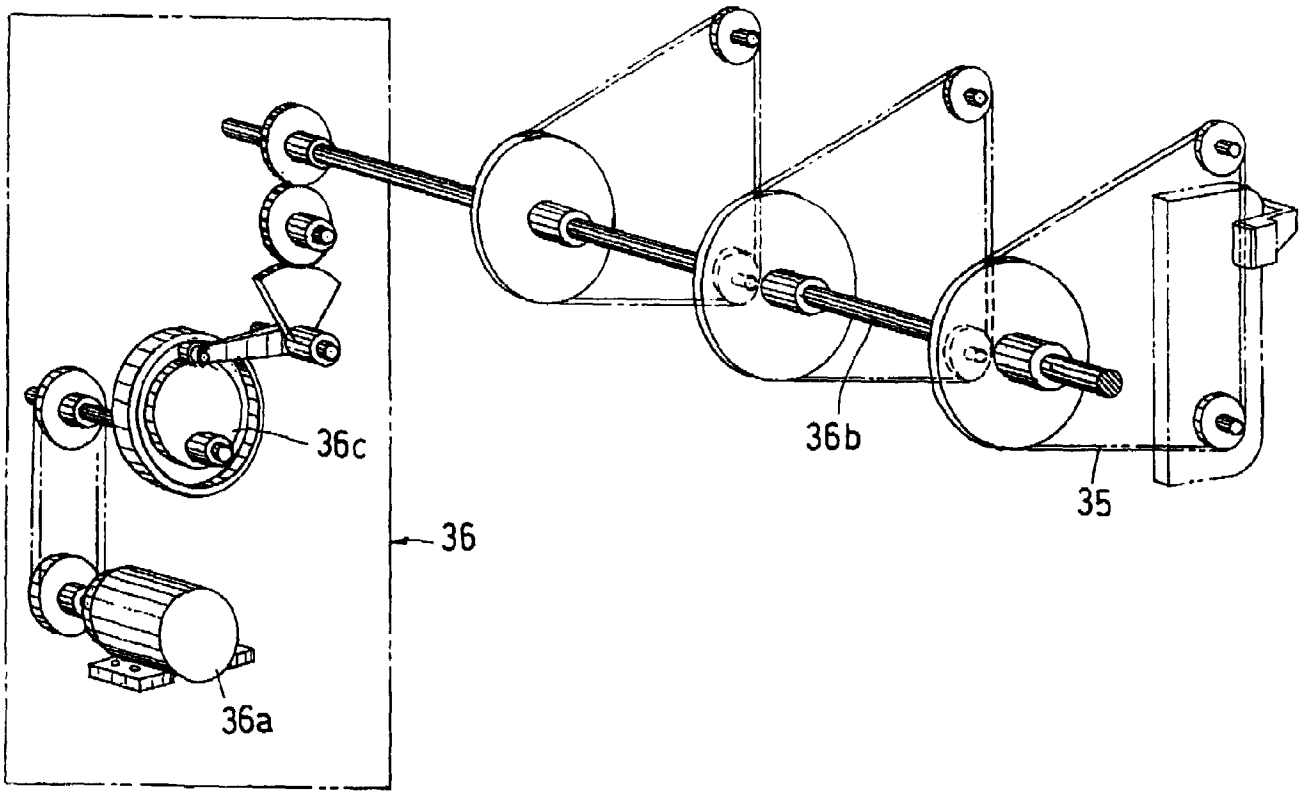
FIG. 15 is an explanatory drawing showing the drive mechanism of the thread tensioning mechanism.
Figure 16:
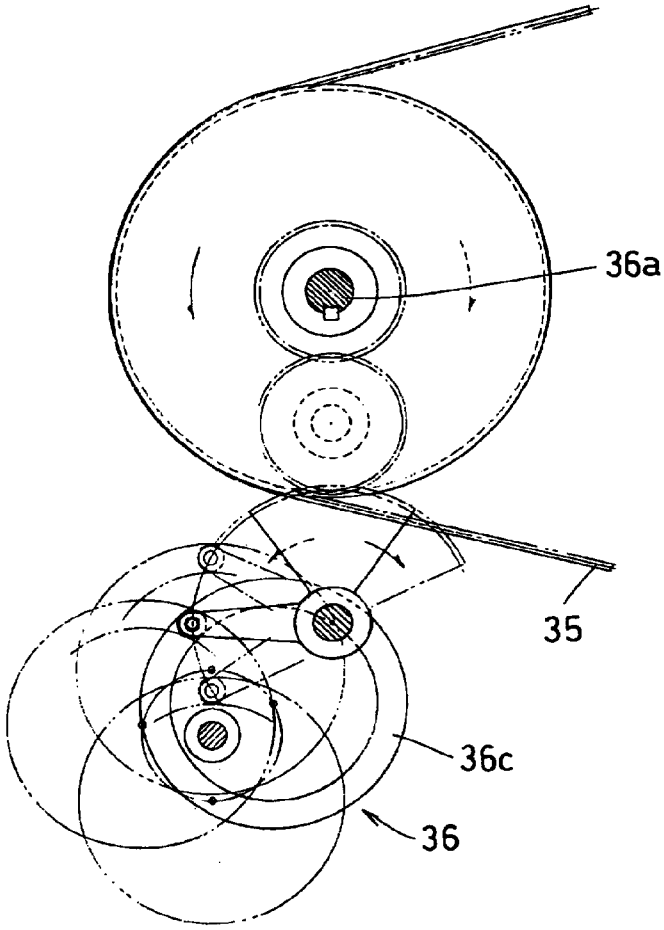
FIGS. 16(A) and 16(B) indicate the speed change mechanism of the drive mechanism for thread tensioning mechanism, (A) being a general view, (B) an explanatory drawing showing the transmission cam, and (C) an explanatory drawing showing the drive speed.
Figure 16:
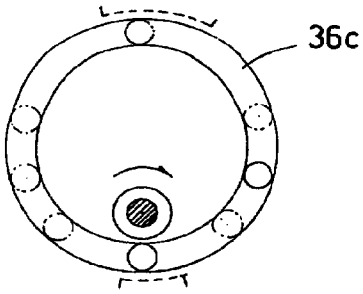
Figure 16:
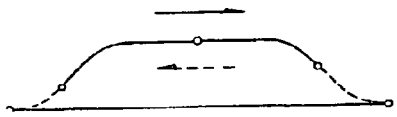
Figure 17:
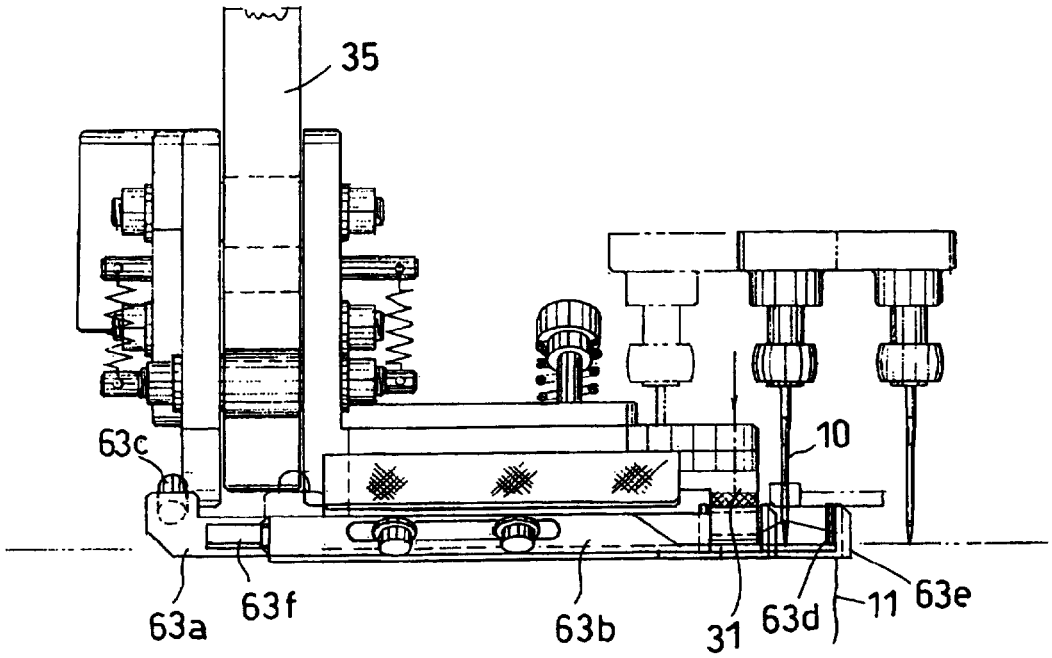
FIG. 17 is a front elevation showing the thread tensioning mechanism and the threading mechanism at the bottom.
Figure 18:
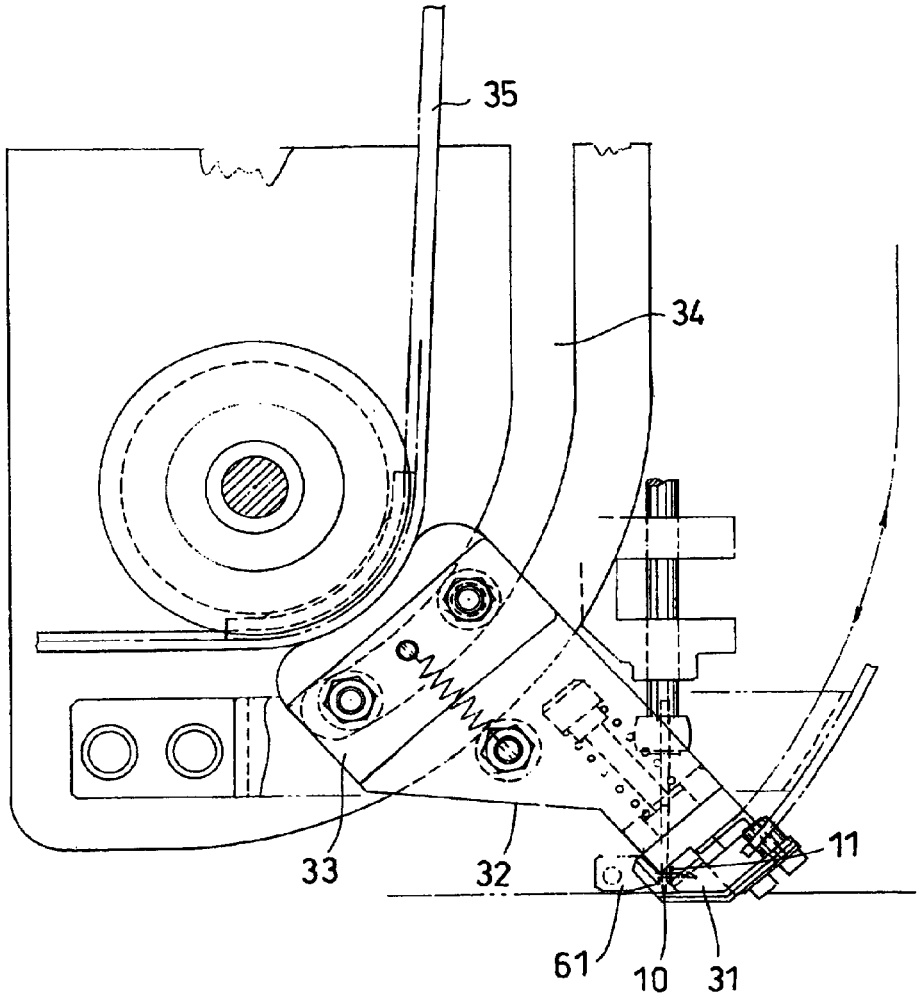
FIG. 18 is a plan view of the thread tensioning mechanism and the threading mechanism.
Figure 19:
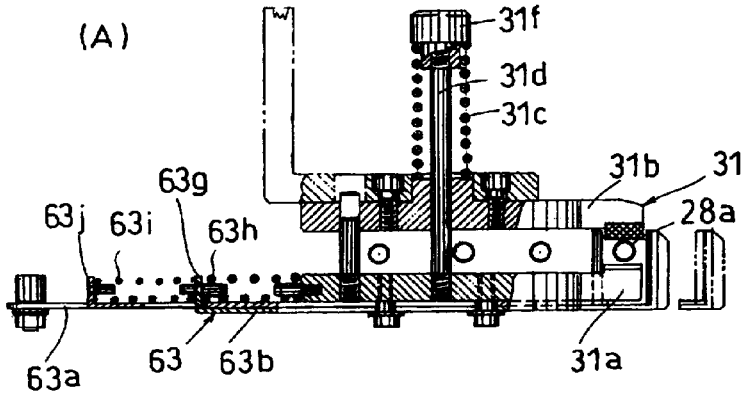
FIGS. 19(A) and 19(B) indicate the thread gripping member of the thread tensioning mechanism and the thread stretching mechanism of the threading mechanism, (A) being a plan view, (B) a front elevation, (C) an explanatory drawing showing the state before the gripping of thread, and (D) an explanatory drawing showing the state of gripping of thread.
Figure 19:
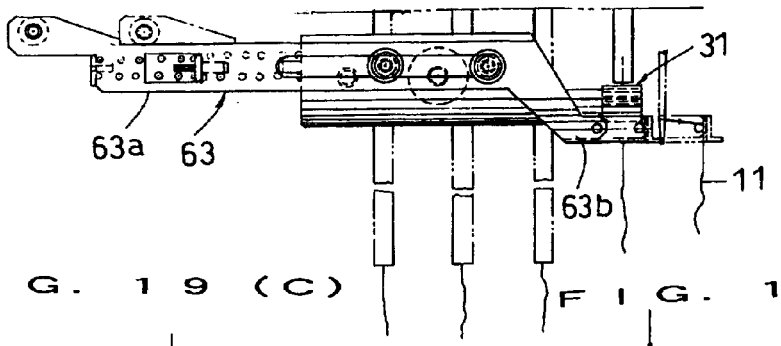
Figure 19:
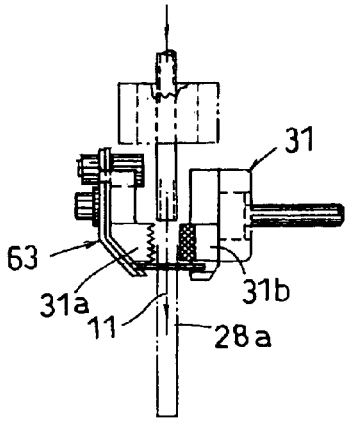
Figure 19:
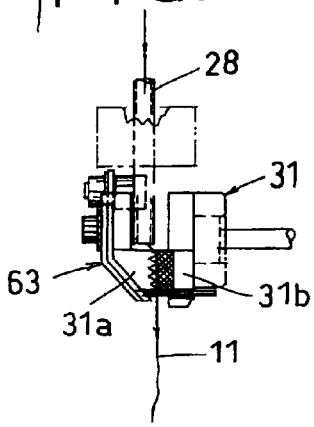
Figure 20:
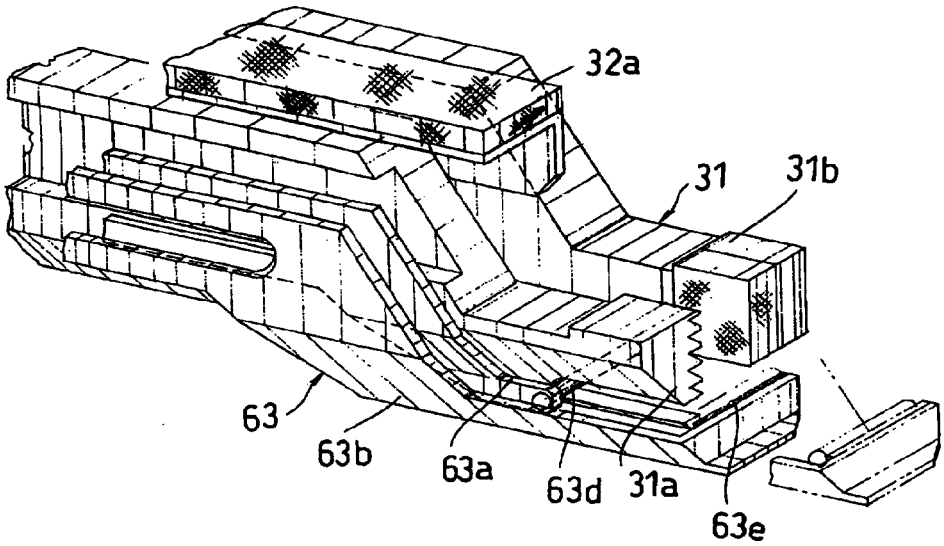
FIG. 20 is a perspective view of the thread gripping member and the thread stretching mechanism.
Figure 21:
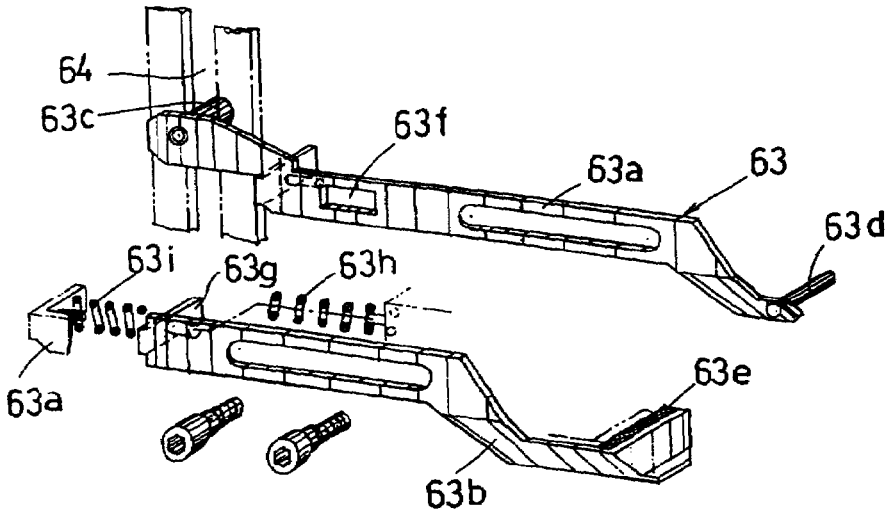
FIGS. 21(A) and 21(B) indicate the thread stretching mechanism of the threading mechanism, (A) being an exploded perspective view, and (B) a front elevation.
Figure 21:
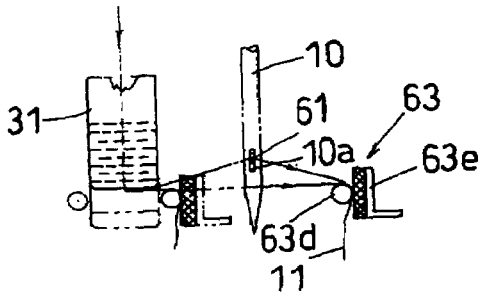
Figure 22:
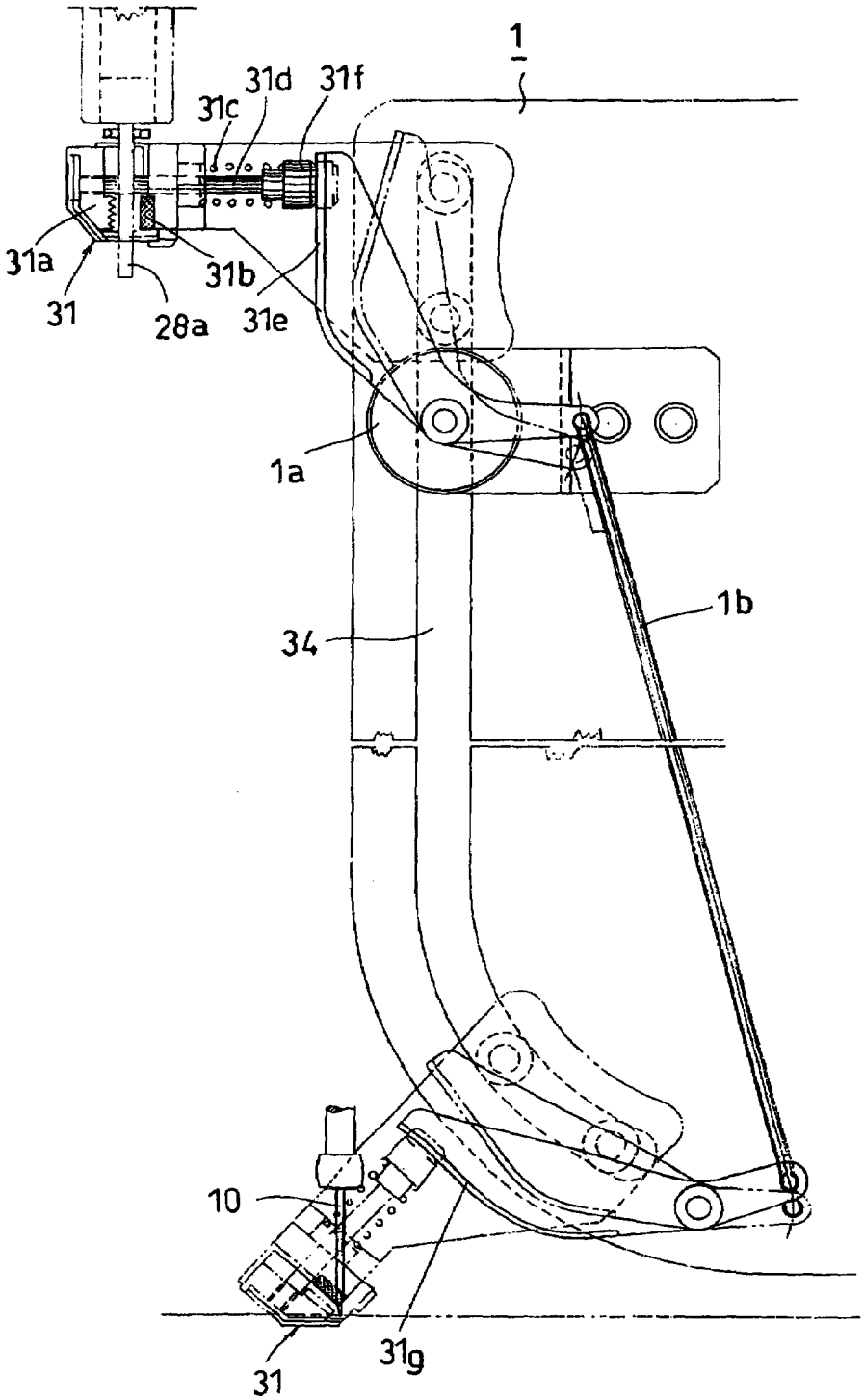
FIG. 22 is a side view showing the drive mechanism of the thread gripping member of the thread tensioning mechanism.
Figure 23:
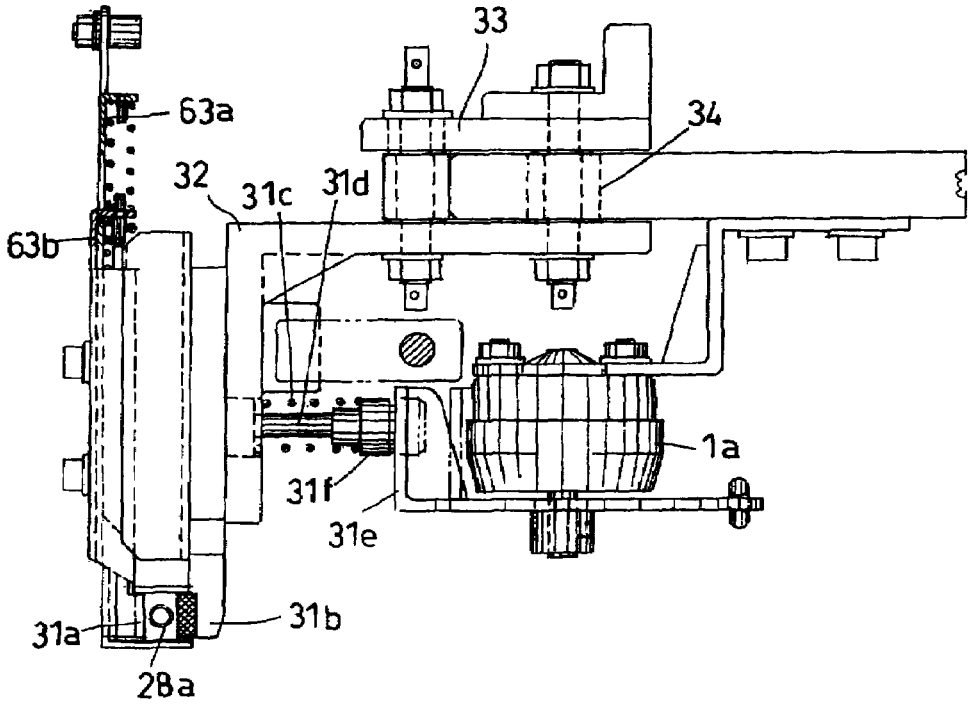
FIG. 23 is a plan view of the drive mechanism.

Moreover, the drive mechanism 36 is constructed in such a way that the drive shaft 36*b* of the belt 35 can be selectively driven in both the normal and reverse directions with the motor 36*a*, as shown in FIG. 15~FIG. 16(C).

And, in this embodiment, the drive mechanism 36 is provided with a speed change cam 36*c* interposed at an intermediate point of the driving force transmission mechanism connecting between the motor 36*a* and the drive shaft 36*b* of the belt 35, to make the moving speed of the thread gripping member 31 moving from the thread feed tube 28*a* to a position close to the needle 10 slow down at the thread feed tube 28*a* and at a position close to the needle 10, but become fast at intermediate position between them.

This enables the thread gripping member 31 to move from the thread feed tube 28*a* to a position close to the needle 10 quickly, without having any influences on the gripping of thread and the threading process, thus shortening the time required for changing of colored thread.

While, in this embodiment, a speed change cam 36*c* is used for changing the moving speed of the thread gripping member 31, the speed change mechanism is not restricted to it, and it is also all right to change moving speed of the thread gripping member 31 by making the rotational speed of the motor 36*a* itself variable by using a stepping motor, etc. for the motor 36*a*.

The drive mechanism 36 of the thread tensioning mechanism 3 may be constructed in a way to be driven independently at each sewing machine head 1 of the embroidery machinery, by interposing a proper clutch mechanism (not illustrated) such as a key, etc. driven by an electromagnetic clutch or solenoid, to thereby enable to perform processing relating to all threads 11 including processing in case of breakage of threads 11, and further improve the operating rate and productivity of the sewing machine.

Furthermore, on the thread tensioning mechanism 3 are disposed limit switches (not illustrated) at proper positions in the lifting route of the sliding piece 33 such as, for example, the standby position near the intermediate position of the thread gripping member 31, the highest position where the thread gripping member 31 grips the end of the threads 11 hanging from the thread feed tube 28*a* and the lowest position where it performs threading, to enable to detect the position of the sliding piece 33. The position where to dispose the limit switch is decided in such a way to be adjustable as required.

Still more, the thread tensioning mechanism 3 is so designed that the thread feed tube 28*a* from which threads other than the threads 11 gripped by the thread gripping member 31 are hanging is pushed up, with the top face of the lever 32 of the thread tensioning mechanism 3, against the urging force of the compression spring 28*b*, when the thread gripping member 31 is moved from the thread feed tube 28*a* to the highest position where it grips the end of the threads 11 hanging from the thread feed tube 28*a*.

On the top face of the lever 32 is disposed a softening agent 32*a* such as felt, etc. to prevent the threads 11 hanging from the thread feed tube 28*a* from being gripped between the top face of the lever 32 and the bottom end of the thread feed tube 28*a* to be damaged, at that time.

Figure 11:
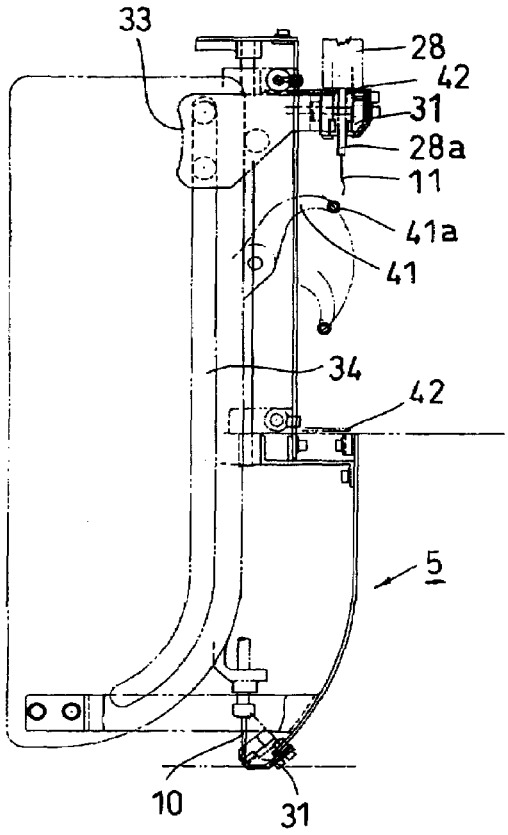
FIGS. 11(A) and 11(B) indicate the threading device, (A) being a side view, and (B) a front elevation.
Figure 11:
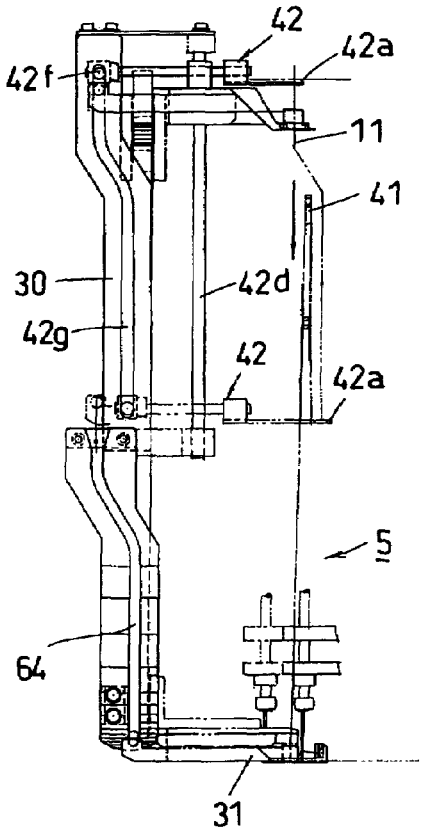
Figure 12:
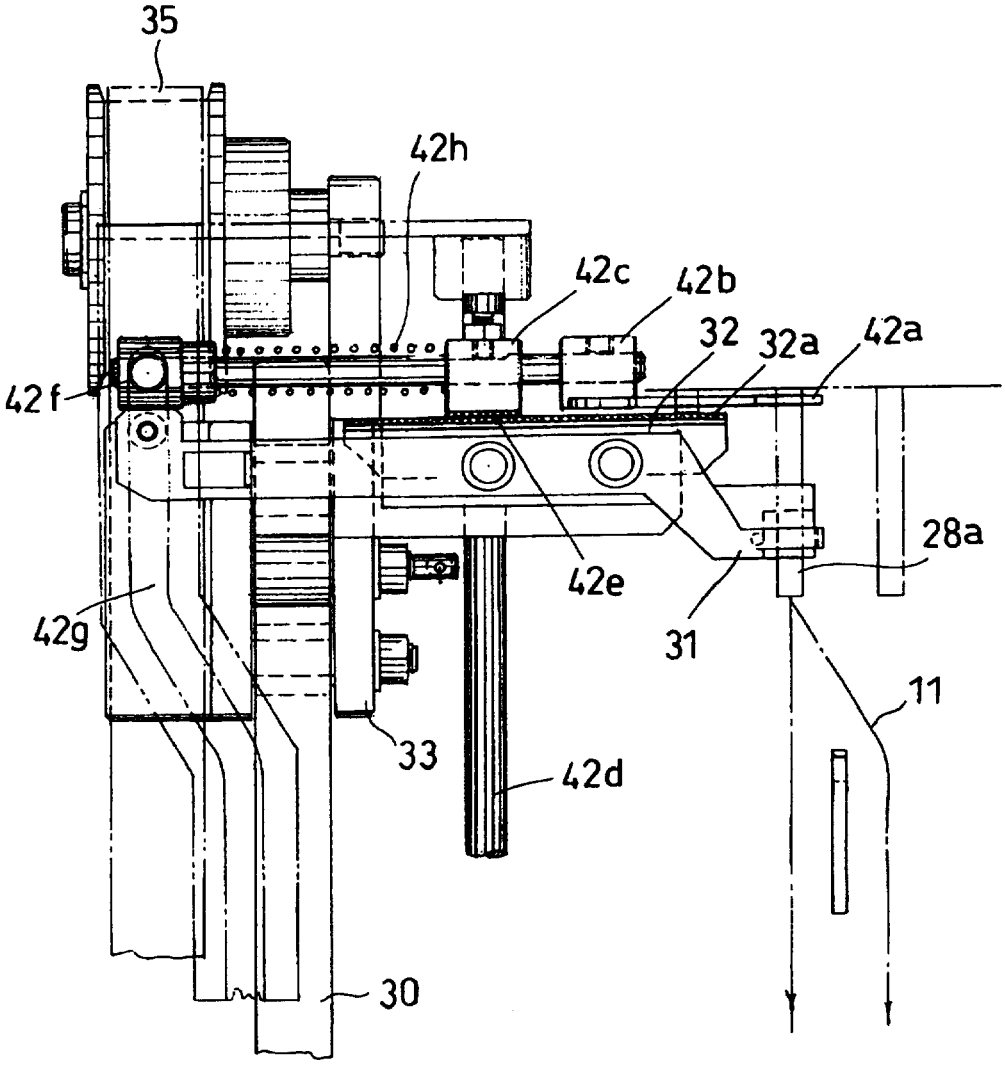
FIG. 12 is a front elevation showing the needle tensioning mechanism and the balancing mechanism in at the top.
Figure 13:
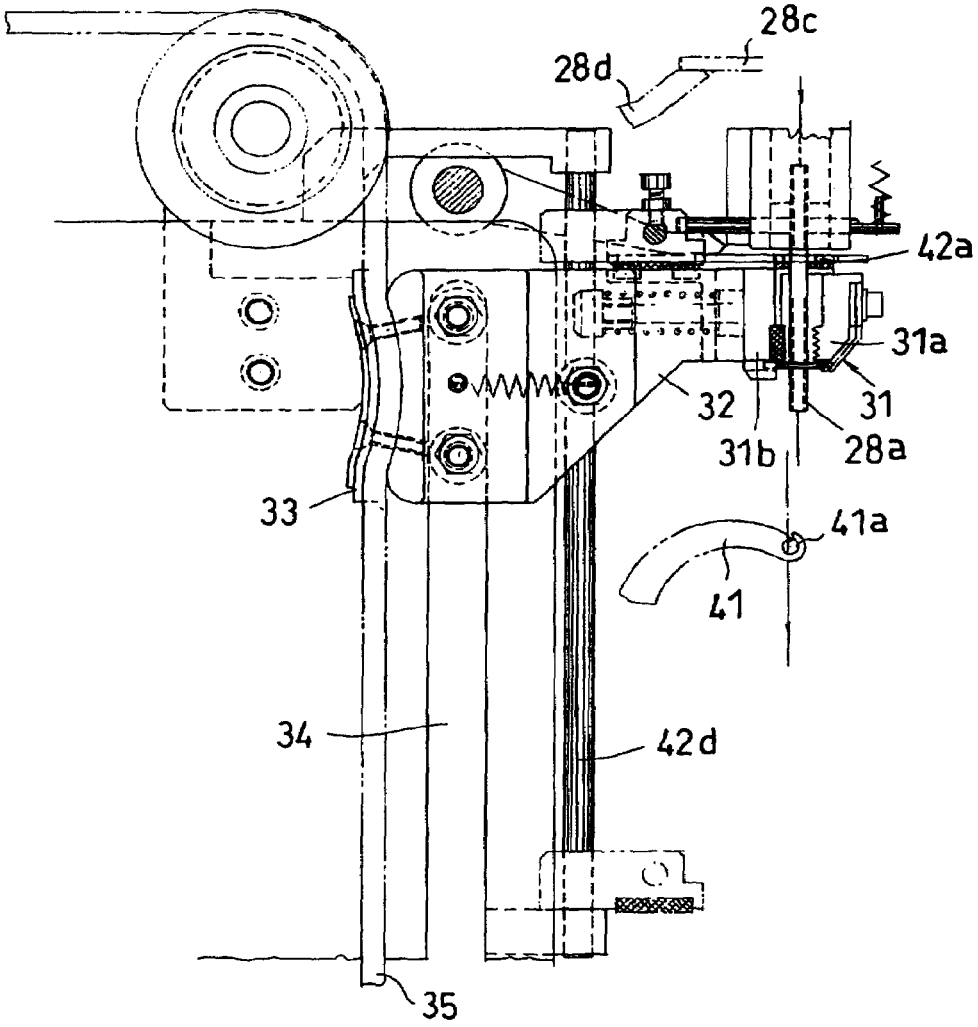
FIG. 13 is a side view of the needle tensioning mechanism and the balancing mechanism.
Figure 14:
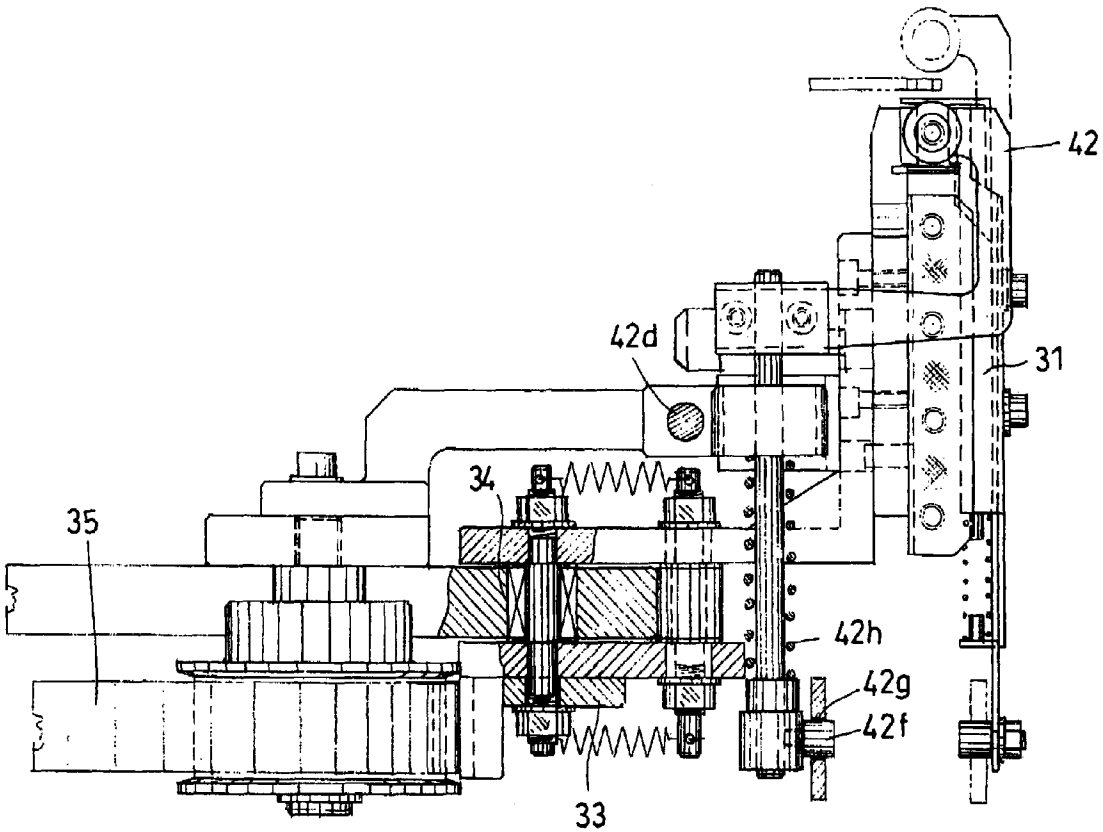
FIG. 14 is a front elevation of the needle tensioning mechanism and the balancing mechanism.

The threads 11 stretched between the thread feed tube 28*a* of the thread feeder 2 and a position close to the needle 10 by the thread tensioning mechanism 3 are placed on the balance 41 and the auxiliary balance 42 of the balancing mechanism 4, as shown in FIG. 11.

While, in this embodiment, the balancing mechanism 4 and the needle 10 corresponding to this balancing mechanism 4 are provided in 2 sets, and the frame 1*c* on which are provided those needles 10 is constructed in a way to swing in a horizontal plane. It is also possible to increase the number of sets of the needles 10 to be provided on the frame 1*c* or construct the frame 1*c* in a way to slide in a horizontal plane.

In the balance 41 is formed a thread hooking hole 41*a* having a notch at the tip through which the threads 11 may be inserted.

The auxiliary balance 42 is composed of a ring-shaped thread hooking hole 42*a*, a lever 42*b* forming the thread hooking hole 42*a* at the front end, a sliding piece 42*c* for slidably supporting the lever 42*b*, a guide tube 42*d* of the sliding piece 42*c* disposed about in vertical direction on the main body of the thread tensioning mechanism 30, a magnet piece 42*e* for bringing the sliding piece 42*c* up and down along the guide tube 34 along with the rise and fall of the thread gripping member 31 by sticking to the thread gripping member 31 of the thread tensioning mechanism 3, a guide groove 42*g* for controlling the position of the thread hooking hole 42*a* by guiding a roller 42*f* disposed at the other end of the lever 42*b*, and a spring member 42*h* for urging the roller 42*f*, disposed at the other end of the lever 42*b*, to contact with the guide groove 42*g*.

This auxiliary balance 42 of the balancing mechanism 4 makes the thread gripping member 31 move from the standby position at about the middle part to the highest position where to grip the end of the threads 11 hanging from the thread feed tube 28*a*, by driving the belt 35 with the drive mechanism 36 of the thread tensioning mechanism 3. And then the sliding piece 42*c* also moves up to the highest position following the thread gripping member 31, and the thread feed tube 28*a* and the end of the threads 11 hanging from the thread feed tube 28*a* are inserted in the thread hooking hole 42*a*.

And, as the thread gripping member 31 located right under the thread hooking hole 42*a* grips the threads 11 and the belt 35 is driven by the drive mechanism 36 of the thread tensioning mechanism 3, the thread gripping member 31 moves from the highest position to the lowest position. At that time, the sliding piece 42*c* also comes down by sticking to the thread gripping member 31, but the sliding piece 42*c* is blocked by the bottom end of the guide groove 42*g* at about the middle position and cannot descend beyond that point. The sliding piece 42*c* is therefore separated from the thread gripping member 31, and remains in this position, i.e., the standby position at the bottom dead center. In addition, in line with the descent of the sliding piece 42*c*, the lever 42*b* provided at the front end with the thread hooking hole 42*a* in which are inserted the threads 11 slides in horizontal direction according to the shape of the guide groove 42*g* against the urging force of the spring member 42*h*, as the roller 42*f* disposed at the other end contacts with the guide groove 42*g*, to thereby pass the threads 11 into the thread hooking hole 41*a* formed at the front end of the balance 41, while the sliding piece 42*c* descends.

The thread hooking hole 41*a* of the balance 41 shall preferably form a locking device such as a trap, etc. for protection against falling of the threads 11 inserted in it.

This makes it possible for the threads 11 to be hooked in the thread hooking hole 41*a* of the balance 41 and the thread hooking hole 42*a* of the auxiliary balance 42, to perform embroidery in the state held in the prescribed zigzag shape.

During the embroidery, the balance 41 is alternately driven by a drive mechanism similar to that of conventional embroidery machinery, while, on the other hand, the auxiliary balance 42 is held in the standby position at the bottom dead center.

The threading mechanism 6, designed to guide the threads 11, led to a position close to the needle 10 by the thread tensioning mechanism 3, to the needle hole 10*a* of the needle 10, and perform threading, is composed of a thread pull-out mechanism 61 provided with a hooking member 61*a*, a drive mechanism 62 for the thread pull-out mechanism 61, and a thread stretching mechanism 63, movably mounted on the thread gripping member 31, for stretching the end part of the threads 11 gripped by the thread gripping member 31 about horizontally on the hooking member 61*a* of the thread pull-out mechanism 61, in the space formed with the thread gripping member 31.

The thread pull-out mechanism 61 is composed of a hooking member 61*a* the tip of which is formed in the shape of a hook, and a supporting member 61*b* on which is mounted the hooking member 61*a*.

Figure 28:
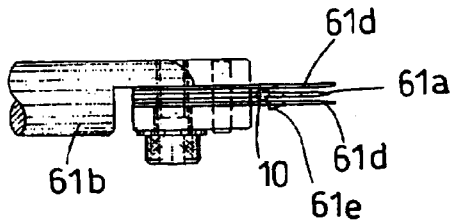
FIGS. 28(A)–28(E) indicate a modified embodiment of the thread pull-out mechanism of the threading mechanism, (A) being a plan view, (B) a side view, (C) a front elevation, (D) an explanatory drawing showing the state before pulling out of thread, and (E) an explanatory drawing showing the state after the thread is pulled out.
Figure 28:
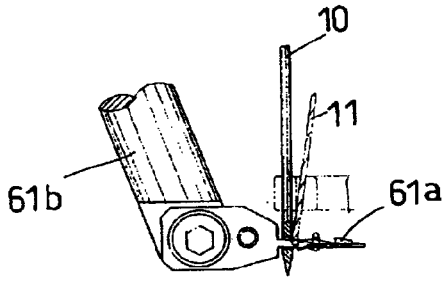
Figure 28:
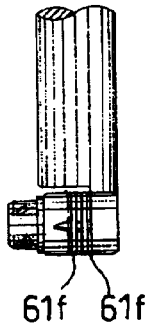
Figure 28:
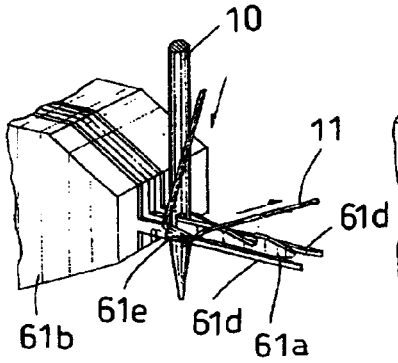
Figure 28:
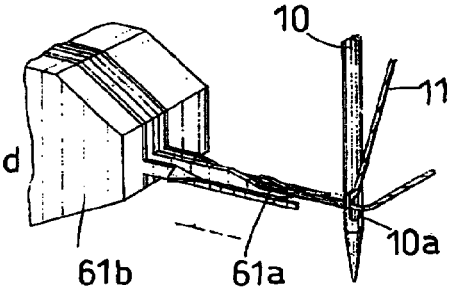

While, in this embodiment, the thread pull-out mechanism 61 is constructed by simply mounting a hooking member 61*a* the tip of which is formed in the shape of a hook on a supporting member 61*b*, a thread pull-out mechanism 61 may also be used which comprises guide pieces 61*d*, 61*d* disposed, through spacers 61*f*, 61*f*, on both sides of the hooking member 61*a* of the thread pull-out mechanism 61, and forms a projection 61*e* for temporarily fastening the threads 11 at least to the guide piece 61*d* on one side as shown in FIG. 28, to make it possible to stretch the thread held in the operator's fingers, when manually performing processing in case of breakage of the thread 11, about horizontally on the hooking member 61*a* of the thread pull-out mechanism 61.

Figure 29:
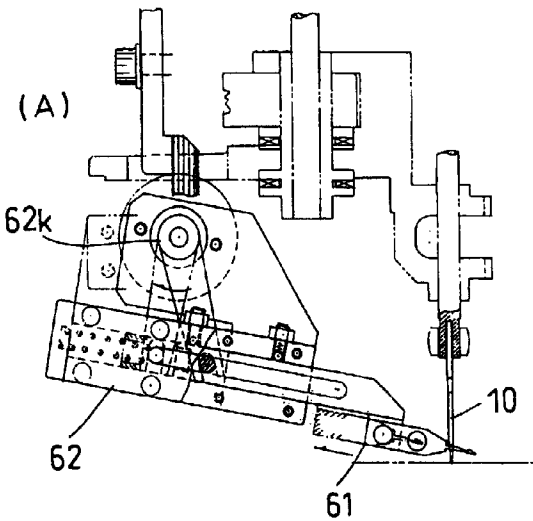
FIGS. 29(A)–29(C) indicate a modified embodiment of the drive mechanism of the thread pull-out mechanism, (A) being a side view, (B) a front elevation, and (C) a perspective view.
Figure 29:
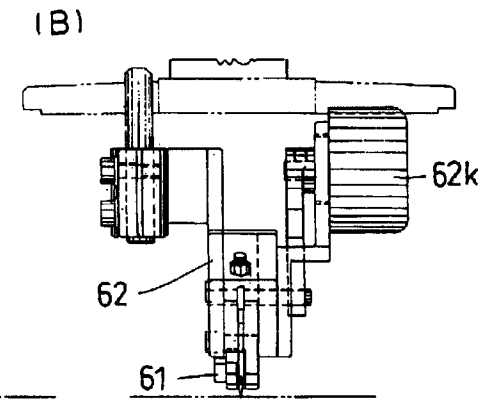
Figure 29:
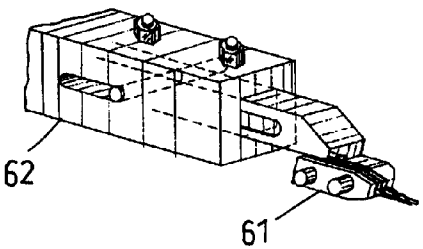

Moreover, while, in this embodiment, the thread pull-out mechanism 61 is constructed in such a way that the thread pull-out mechanism 61 descends and advances to insert the tip of the hooking member 61*a* in the needle hole 10*a*, and then retreats and goes up, so that the standby position of the thread pull-out mechanism 61 may be positioned fairly higher than the position of the needle hole 10*a* of the needle 10, to prevent the thread pull-out mechanism 61 from contacting with the product to be embroidered such as hat, for example, the thread pull-out mechanism 61 may also be constructed, in the case of an embroidery machine intended for ordinary products without ups and downs, in such a way that the thread pull-out mechanism 61 is made to advance linearly from off above, by means of a drive mechanism 62*k* such as rotary solenoid, etc. disposed on the sewing machine head 1, as shown in FIG. 29, to insert the tip of the hooking member 61*a* in the needle hole 10*a*, and then retreats linearly upward.

This enables simplification of the construction of the thread pull-out mechanism 61 including the drive mechanism 62*k*.

The drive mechanism 62 of the thread pull-out mechanism 61 is composed of a holding member 62*a* slidably disposed on the frame 1*c* on the sewing machine head 1 side, for supporting the supporting member 61*b* of the thread pull-out mechanism 61, a drive lever 62*b* fit to the holding member 62*a* at the middle part through an axis 62*i*, for driving the supporting member 61*b* slidably held by the holding member 62*a*, and a drive mechanism 62*c* of the drive lever 62*b*.

The threading mechanism 6 pushes down the pin 61*c* fixed to the supporting member 61*b* inserted in the slit 62*d* provided on the other end side of the drive lever 62*b*, by pressing one end of the drive lever 62*b* with the drive mechanism 62*c*, and makes the thread pull-out mechanism 61 descend through the supporting member 61*b* to which is fixed the pin 61*c*, by making the pin 61*c* descend along the groove 62*e* formed in the holding member 62*a*.

By further pushing forward, in this state, one end of the drive lever 62*b* with the drive mechanism 62*c*, the axis 62*i* of the drive lever 62*b* is made to advance along the frame 1*c*, to thereby make the holding member 62*a* and the supporting member 61*b* of the thread pull-out mechanism 61 advance, so that the tip of the hooking member 61*a* of the thread pull-out mechanism 61 may be inserted in the needle hole 10*a*.

And, it is so arranged that the holding member 62*a* is gripped by a gripping member 62*f* such as sheet spring, etc., at the position of the frame 1*c*, to make the holding member 62*a* slides accurately and stabilizes in position in the frame 1*c*.

Furthermore, an urging member 62*g* such as compression spring, etc. is disposed at the inner bottom of the holding member 62*a* in which is inserted the supporting member 61*b*, to make the supporting member 61*b* of the thread pull-out mechanism 61 slides accurately and stabilizes in position in the holding member 62*a*.

Still more, a cam plate 62*h*, for guiding the pin 62*i* provided in projection on the drive lever 62*b*, is provided on the frame 1*c*, so that, when inserting the tip of the hooking member 61*a* of the thread pull-out mechanism 61 in the needle hole 10*a*, first the thread pull-out mechanism 61 descends, in line with driving of the drive mechanism 62*c*, while, on the other hand, when extracting the tip of the hooking member 61*a* of the thread pull-out mechanism 61 from the needle hole 10*a*, first the thread pull-out mechanism 61 retreats, and then goes up.

The drive mechanism 62*c* of the thread pull-out mechanism 61 may be slidably constructed independently for each sewing machine head 1 of the embroidery machine in a way to be capable of individual driving, to thereby make it possible to perform all processings relating to all the threads 11 including processing in case of breakage of thread 11 automatically, and make the thread pull-out mechanism 61 available for use also when performing the processing in case of breakage of thread 11 manually, further improving the operating rate and productivity of the sewing machine.

Yet more, while, in this embodiment, the thread pull-out mechanism 61 is constructed in such a way that the thread pull-out mechanism 61 descends and advances to insert the tip of the hooking member 61*a* in the needle hole 10*a*, and then retreats and goes up, so that the standby position of the thread pull-out mechanism 61 may be positioned fairly higher than the position of the needle hole 10*a* of the needle 10, to prevent the thread pull-out mechanism 61 from contacting with the product to be embroidered such as hat, for example, the thread pull-out mechanism 61 may also be constructed, in the case of an embroidery machine intended for ordinary products without ups and downs, in such a way that the thread pull-out mechanism 61 is made to advance linearly from off above, by means of a drive mechanism 62*k* such as rotary solenoid, etc. disposed on the sewing machine head 1, as shown in FIG. 29, to insert the tip of the hooking member 61*a* in the needle hole 10*a*, and then retreats linearly off upward.

This enables simplification of the construction of the thread pull-out mechanism 61 including the drive mechanism 62*k*.

By the way, a needle supporting mechanism 7 is disposed movably facing the hooking member 61*a* of the thread pull-out mechanism 61, for preventing deflection of the needle 10, by correcting deflection of the needle 10, when making the thread pull-out mechanism 61 descend to insert the tip of the hooking member 61*a* in the needle hole 10*a*.

Figure 24:
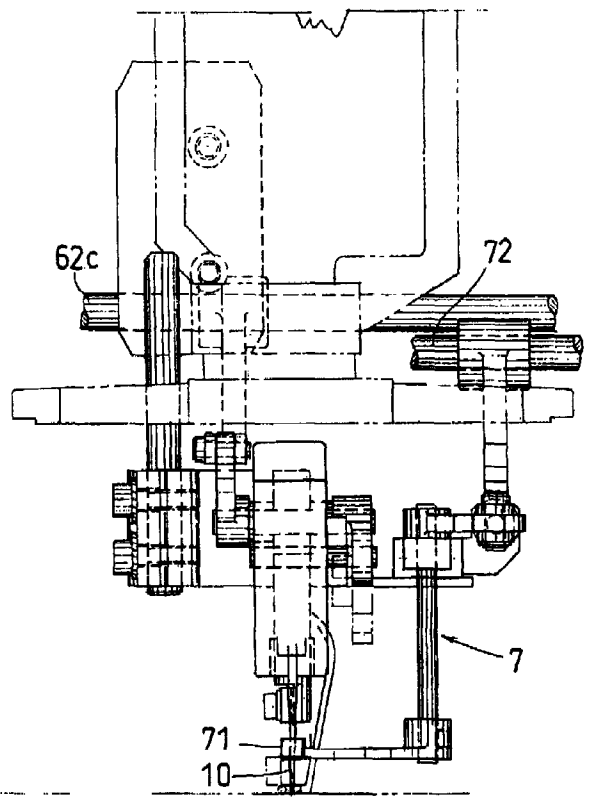
FIGS. 24(A) and 24(B) indicate the thread pull-out mechanism of the threading mechanism and the drive mechanism for it, (A) being a side view, (B) a plan view.
Figure 24:
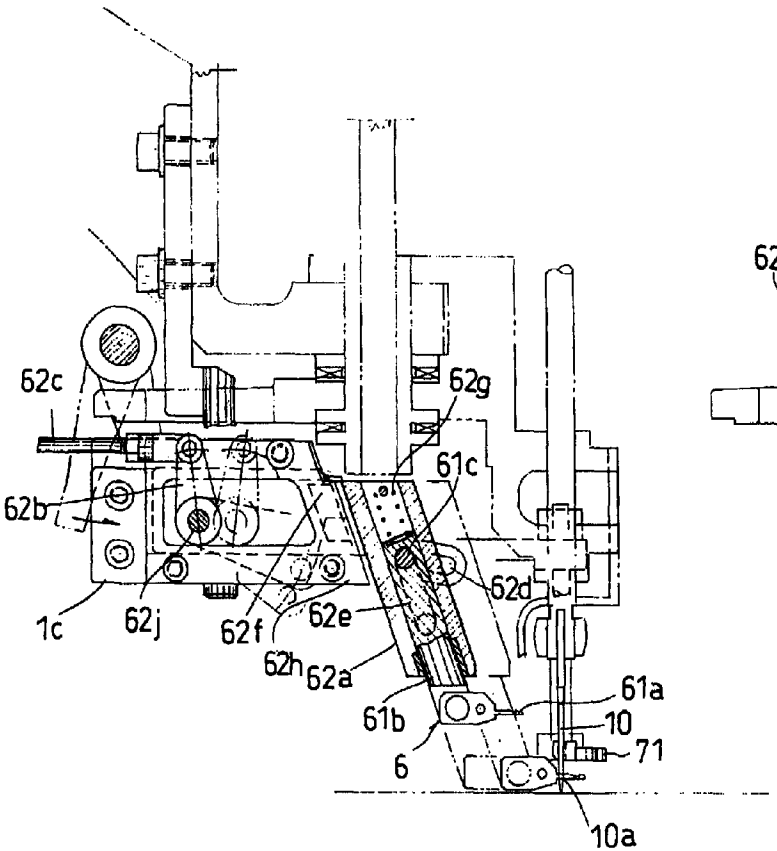
Figure 25:
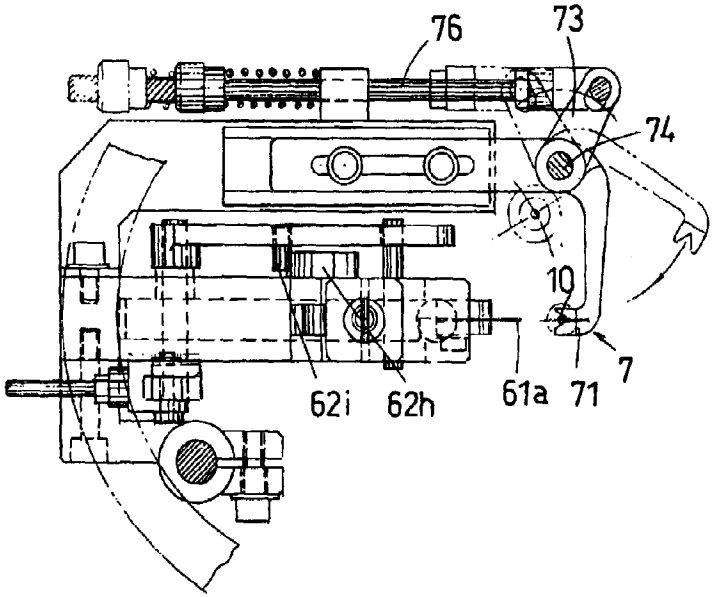
FIG. 25 is a plan view of the thread pull-out mechanism.
Figure 26:
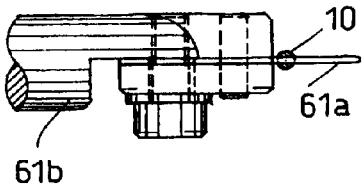
FIGS. 26(A)–26(C) indicate the thread pull-out mechanism of the threading mechanism, (A) being a plan view, (B) a side view, and (C) a front elevation.
Figure 26:
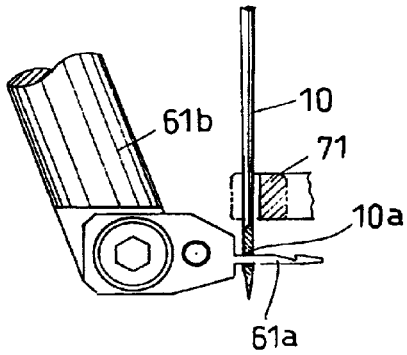
Figure 26:
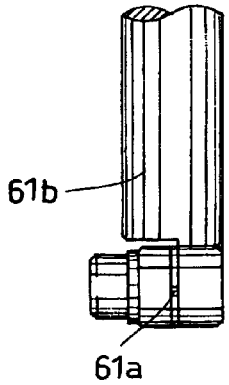

This needle supporting mechanism 7 is constructed, as shown in FIG. 24(A)~FIG. 25, with a needle supporting member 71 the tip of which is formed in about a V shape, and a drive mechanism 72 for swinging the needle supporting member 71, through a lever 73 and a rod 76 mounted on the base end side of the needle supporting member 71, so that it may support the needle 10 by swinging it in about a horizontal plane with a spindle 74.

In that case, the needle support mechanism 7 may be constructed in a way to support the needle 10 by swinging in about a horizontal plane from the standby position, as shown in this embodiment, or constructed in such a way that it supports the needle 10 by swinging in about a vertical plane from the standby position, as described later (embodiment indicated in FIG. 30~FIG. 33).

This increases freedom of design of the needle support mechanism 7 and makes it possible to accurately prevent the needle support mechanism 7 from contacting with the thread tensioning mechanism 3 and other accessory mechanisms of the embroidery machinery, and to thus secure smooth drive of the respective mechanisms easily.

And, it is so arranged as to drive the needle support member 71 by operating the drive mechanism 72, before inserting the tip of the hooking member 61*a* in the needle hole 10*a* by making the thread pull-out mechanism 61 descend and advance, so as to support the needle 10 with the tip of the needle support member 71 formed in about a V shape.

This makes it possible to prevent deflection of the needle 10 when inserting the hooking member 61*a* of the thread pull-out mechanism 61 in the needle hole 10*a*, so as to insert the hooking member 61*a* in the needle hole 10*a* smoothly and perform the threading more accurately.

The drive mechanism 72 of the needle support mechanism 7 may be drivably constructed independently for each sewing machine head 1 of the embroidery machine in a way to be capable of individual driving, to thereby make it possible to perform processing relating to all the threads 11 including processing in case of breakage of thread automatically, and make the thread pull-out mechanism 61 available for use also when performing the processing in case of breakage of thread 11 manually, further improving the operating rate and productivity of the sewing machine.

The thread stretching mechanism 63, designed for stretching the end part of the threads 11 gripped by the thread gripping member 31 on the hooking member 61*a* of the thread pull-out mechanism 61 about horizontally in the space formed with the thread gripping member 31, is composed of a first sliding member 63*a* and a second sliding member 63*b* slidably mounted on the thread gripping member 31. And, on the first sliding member 63*a* are formed a sliding piece 63*c* sliding along the guide groove 64 disposed in about the vertical direction in the main body of the thread tensioning mechanism 30 at the base end and a bar-shaped thread gripping piece 63*d* at the tip, respectively.

Moreover, on the second sliding member 63*b* is formed a flat shaped thread gripping piece 63*e* at the tip.

Figure 27:
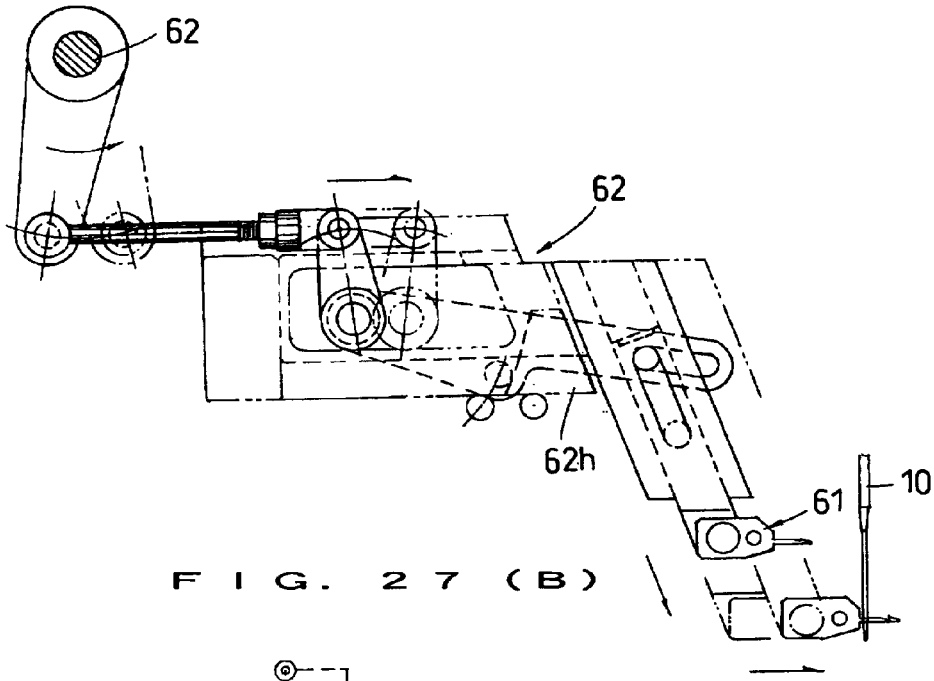
FIGS. 27(A) and 27(B) indicate the thread pull-out mechanism of the threading mechanism, (A) being a motion explanatory drawing, and (B) an explanatory drawing showing the sequence of motions.
Figure 27:
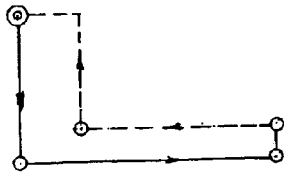

And, the sliding piece 63*c* of the first sliding member 63*a* slides along the guide groove 64, in line with the descent of the thread gripping member 31, and the first sliding member 63*a* slides to the right, in FIG. 27. To make, at that time, the first sliding member 63*a* and the second sliding member 63*b* move together, after the first sliding member 63*a* moved by a prescribed distance, or about 10 mm, for example, against the second sliding member 63*b*, it is so arranged as to insert a fastening piece 63*g*, formed at the base end of the second sliding member 63*b*, in a window 62*f* formed in the first sliding member 63*a*, and dispose a spring 63*h* for controlling movement to the right of the second sliding member 63*b* between the fastening piece 63*g* formed at the base end of the second sliding member 63*b* and the thread gripping member 31, and dispose a spring 63*i* for controlling movement to the right of the first sliding member 63*a* between the fastening piece 63*j* formed at the base end of the first sliding member 63*a* and the fastening piece 63*g* formed at the base end of the second sliding member 63*b*, respectively.

In that case, it is so constructed that, by setting the spring constant of the spring 63*i* smaller than the spring constant of the spring 63*h*, first the spring 63*i* is greatly deformed, when an external force is applied to it, and then the spring 63*h* is deformed, to make it possible for the first sliding member 63*a* and the second sliding member 63*b* to make the above-mentioned motion.

This thread stretching mechanism 63 descends together with the thread gripping member 31, when moving the thread gripping member 31 from the highest position where to grip the end part of the threads 11 hanging from the thread feed tube 28*a* to the lowest position, by driving the belt 35 with the drive mechanism 36 of the thread tensioning mechanism 3.

And, it is so arranged as to grip the end part of the threads 11, gripped by the thread gripping member 31 located between the thread gripping piece 63*d* of the first sliding member 63*a* and the thread gripping piece 63*e* of the second sliding member 63*b*, with the thread gripping piece 63*d* and the thread gripping piece 63*e*, as the sliding piece 63*c* of the first sliding member 63*a* slides along the guide groove 64, in line with the descent of the sliding piece 42*c*, and stretch it about horizontally on the hooking member 61*a* of the thread pull-out mechanism 61 where the end part of the threads 11 is inserted in the needle hole 10*a*, in the space formed with the thread gripping member 31.

And, after stretching the end of this thread 11 about horizontally on the hooking member 61*a* of the thread pull-out mechanism 61 inserted in the needle hole 10*a*, the thread stretching mechanism 63 drives the drive lever 62*b* with the drive mechanism 62*c*, to make the thread pull-out mechanism 61 retreat and, while hooking the thread 11 on the hooking member 61*a* of the thread pull-out mechanism 61 the tip of which is formed in the shape of a hook, extracts the hooking member 61*a* from the needle hole 10*a*, and pushes the contact member 31*f* disposed at the tip of the operating piece 31*d* provided in projection on the mobile gripping piece 31*a* of the thread gripping member 31, with the shoe member 31*g* swung by a drive mechanism 1*a* such as rotary solenoid, etc. through a connecting rod 1*b*, to cancel the grip of the thread 11 by opening the mobile gripping piece 31*a* against the urging force of the spring member 31*c*, to perform threading.

By the way, the embroidery machine of this embodiment is so arranged as to drive the thread selecting mechanism 29 of the thread feeder 2, when the thread gripping member 31 of the thread tensioning mechanism 3 of the threading device 5 dropped to about the middle point (right under the lowest position of the auxiliary balance 42 of the balance mechanism 4 to be described later), as shown in FIG. 1, to make the thread feed tube 28*a* move sideways (to the right) by a step in the state where the thread 11 is stretched, for threading, before performing embroidery.

Next, explanation will be made on the operating method of the embroidery machine according to the present invention.

First, the operating method in the stage before embroidery will be explained.

When starting an embroidery work, store bobbins 21 of colored threads respectively, in the bobbin housing 22 of the thread feed & recovery device 2 at the sewing machine head 1 of the embroidery machine, stretch the threads 11 delivered from the bobbins 21 on the thread tension regulating mechanism 24 through the thread holder 23, and let hang the end part of the threads 11 by a prescribed length from the thread feed tube 28*a*.

At that time, on the thread length regulating mechanism 26, hold the threads 11 delivered toward the needle 10 at prescribed length or, to be concrete, by a length at which the thread 11 of the length required for starting the embroidery work is inserted in the needle 10, when the tip of the thread 11 is led to a position close to the needle 10 by the threading device 5.

Next, the operating method for starting embroidery will be explained.

By driving the thread selecting mechanism 29, slide the thread tension regulating mechanism 24, and position the thread feed tube 28*a* of the thread feed mechanism 28 corresponding to the prescribed bobbins 21, selectively and accurately, over the threading device 5 which performs threading.

After that, drive the belt 35 of the thread tensioning mechanism 3, to make the thread gripping member 31 of the thread tensioning mechanism 3 move from the standby position at about the middle part (right under the lowest position of the auxiliary balance 42 of the balance mechanism 4) to the highest position where to grip the end of the thread 11 hanging from the thread feed tube 28*a*.

And, in the state in which the thread feed tube 28*a* is positioned between the mobile gripping piece 31*a* and the fixed gripping piece 31*b* of the thread gripping member 31 in the thread tensioning mechanism 3 of the threading device 5, drive the drive mechanism 28*e* of the operating lever 28*d*, to operate the operating piece 28*c* of the thread feed tube 28*a* with the operating lever 28*d*, so as to make the thread feed tube 28*a* go up against the urging force of the compression spring 28*b* and expose the threads 11, and to hold the threads 11 with the mobile gripping piece 31*a* and the fixed gripping piece 31*b* of the thread gripping member 31 in the thread tensioning mechanism 3 of the threading device 5.

And, drive the drive shaft 27*a* of the drive mechanism 27 on the sliding member 26*a* of the thread length regulating mechanism 26, to swing the sliding member 26*a* through the lever 27*c*, the sliding rod 27*e* and the pushing member 27*g*, and, let descend the thread gripping member 31 by driving the belt 35 of the thread tensioning mechanism 3, while making the thread inserter 26*b* formed at the tip of the sliding member 26*a* move from the thread holding position 26B to the feed position 26A. And, when the thread gripping member 31 in the thread tensioning mechanism 3 of the threading device 5 descended close to about the middle part right under the lowest position of the auxiliary balance 42 of the balance mechanism 4, drive the thread selecting mechanism 29 of the thread feeder 2, to make the thread feed tube 28*a* move sideways (to the right) by a step in the state where the thread 11 is stretched, and further let the thread gripping member 31 descend to guide the thread 11 to a position close to the needle 10 located in the threading position.

Moreover, the drive shaft 27*a* of the drive mechanism 27 in the thread feed & recovery device 2 is designed to make the thread inserter 26*b* formed at the tip of the sliding member 26*a* move from the thread holding position 26B to the feed position 26A and, immediately after that, drive it in the opposite direction, to make the lever 27*c*, the sliding rod 27*e* and the pushing member 27*g* return to their initial positions.

At that time, the thread 11 stretched between the thread feed tube 28*a* and a position close to the needle 10 located in the threading position, by the thread tensioning mechanism 3, is placed on the balance 41 and the auxiliary balance 42 of the balance mechanism 4, with a swing of the auxiliary balance 42, and the end of the thread 11 gripped by the thread gripping member 31 is stretched between the thread gripping member 31 and the thread stretching mechanism 63. In this state, drive the drive mechanism 62*c* of the thread pull-out mechanism 61 and the drive mechanism 72 of the needle supporting mechanism 7, to place and stretch the thread 11 about horizontally on the hooking member 61*a* of the thread pull-out mechanism 61 inserted in the needle hole 10*a* of the needle 10 supported by the needle supporting member 71.

After inserting the hooking member 61*a* of the thread pull-out mechanism 61 in the needle hole 10*a* of the needle 10, make the needle supporting member 71 retreat to return to its initial position, by driving the drive mechanism 72 of the needle support mechanism 7, before stretching the thread 11.

And, in the state in which the end of the thread 11 is stretched about horizontally on the hooking member 61*a* of the thread pull-out mechanism 61 inserted in the needle hole 10*a* of the needle 10, drive the drive lever 62*b* with the drive mechanism 62*c*, to make the thread pull-out mechanism 61 retreat and, while hooking the thread 11 on the hooking member 61*a* of the thread pull-out mechanism 61 formed in the shape of a hook at the tip, perform threading by extracting the hooking member 61*a* from the needle hole 10*a*, to start embroidery work.

After that, drive the belt 35 of the thread tensioning mechanism 3, to make the thread gripping member 31 return to the standby position near the middle position.

Furthermore, it is so arranged as to cut, when replacing the thread 11, the thread 11 with an automatic thread cutting device disposed below the needle plate (not illustrated), drive the drive shaft 27*b* of the drive mechanism 27 in the sliding members 26*a* of the thread length regulating mechanism 26, to slide the sliding members 26*a* through the lever 27*d*, the sliding rod 27*f* and the pulling member 27*h*, and to recover and reuse the thread 11 stretched between the thread feed & recovery device 2 and the needle 10, by making the thread inserter 26*b* formed at the tip of the sliding members 26*a* move from the thread feed position 26A to the holding position 26B.

Still more, the drive shaft 27*b* of the drive mechanism 27 is designed to recover the thread 11 by moving the thread inserter 26*b* formed at the tip of the sliding members 26*a* from the thread feed position 26A to the holding position 26B, and drive it in the opposite direction immediately after that, to make the lever 27*d*, the sliding rod 27*f* and the pushing member 27*h* return to their initial positions.

At that time, it is possible to drive the drive shaft 27*a* of the drive mechanism 27 in the sliding members 26*a* of the thread length regulating mechanism 26 about simultaneously, as required, to slide the thread inserter 26*b* formed at the tip of the sliding members 26*a*, through the lever 27*c*, the sliding rod 27*e* and the pulling member 27*g*, guide the end of the thread 11 to a position close to the needle 10 with the threading device 5, while feeding the thread 11 by moving the thread inserter 26*b* from the thread holding position 26B to the feed position 26A, place the thread 11 on the balance 41 and the auxiliary balance 42, and pass the thread 11 led to a position close to the needle 10 through the needle hole 10*a* of the needle 10, thereby remarkably shortening the time required for the replacement of colored threads.

In the same way, the process of performing threading and embroidery work can be repeated continuously thereafter.

On the other hand, the processing in case of breakage of the thread 11 can also be made automatically in the same way as in the replacement of the thread 11. In that case, the sliding members 26*a* of the thread length regulating mechanism 26, the thread tensioning mechanism 3, the threading mechanism (not illustrated) of the threading device 5, etc. must be constructed in a way to be driven independently at each sewing machine head 1 of the embroidery machinery, and such construction makes it possible to perform all processing relating to thread including processing in case of breakage of the thread 11 automatically, further improving the operating rate and productivity of the sewing machine.

To be concrete, first cut off the broken thread 11 by using a proper cutting device (not illustrated), align the length of the threads hanging from the thread feed tube 28*a* of the thread feed mechanism 28, and recover the cut pieces of the broken threads 11 placed on the balance mechanism 4, etc. by using a proper recovering device (not illustrated).

About at the same time as above, move the thread feed tube 28*a* sideways by a step (left side facing the front face of the sewing machine head 1).

By driving the thread selecting mechanism 29, slide the thread tension regulating mechanism 24, and position the thread feed tube 28*a* of the thread feed mechanism 28 corresponding to the prescribed bobbins 21, selectively and accurately, over the threading device 5 which performs threading.

After that, drive the belt 35 with the drive mechanism 36, to make the thread gripping member 31 and the thread tensioning mechanism 3 move from the standby position at about the middle part (right under the lowest position of the auxiliary balance 42 of the balance mechanism 4 to be described later) to the highest position where to grip the end of the thread 11 hanging from the thread feed tube 28*a*, to make it possible for the thread gripping member 31 to grip the end of the thread 11.

And, in the state in which the thread feed tube 28*a* is positioned between the mobile gripping piece 31*a* and the fixed gripping piece 31*b* of the thread gripping member 31 in the thread tensioning mechanism 3 of the threading device 5, drive the drive mechanism 28*e* of the operating lever 28*d*, to operate the operating piece 28(*c*) of the thread feed tube 28*a*, with the operating lever 28*d* so as to make the thread feed tube 28*a* go up against the urging force of the compression spring 28*b* and expose the threads 11, and to hold the threads 11 with the mobile gripping piece 31*a* and the fixed gripping piece 31*b* of the thread gripping member 31 in the thread tensioning mechanism 3 of the threading device 5.

After that, drive the drive shaft 27*b* of the drive mechanism 27 on the sliding member 26*a* of the thread length regulating mechanism 26, to slide the sliding member 26*a* through the lever 27*d*, the sliding rod 27*f* and the pushing member 27*h*, and extract the thread 11 from the bobbin 21 by moving the thread inserter 26*b* formed at the tip of the sliding member 26*a* from the thread feed position 26A to the holding position 26B, to maintain the thread 11 sent out toward the needle 10 at the prescribed length.

Next, drive the drive shaft 27*a* of the drive mechanism 27 on the sliding member 26*a* of the thread length regulating mechanism 26, to slide the sliding member 26*a* through the lever 27*c*, the sliding rod 27*e* and the pushing member 27*g*, and, let descend the thread gripping member 31 by driving the belt 35 of the thread tensioning mechanism 3, while making the thread inserter 26*b* formed at the tip of the sliding member 26*a* move from the thread holding position 26B to the feed position 26A. And, when the thread gripping member 31 in the thread tensioning mechanism 3 of the threading device 5 descended close to about the middle part (right under the lowest position of the auxiliary balance 42 of the balance mechanism 4), drive the thread selecting mechanism 29 of the thread feeder 2, to make the thread feed tube 28*a* move sideways (to the right) by a step in the state where the thread 11 is stretched, and further let the thread gripping member 31 descend to guide the thread 11 to a position close to the needle 10 located in the threading position.

Moreover, the drive shaft 27*a* of the drive mechanism 27 in the thread feed & recovery device 2 is designed to make the thread inserter 26*b* formed at the tip of the sliding member 26*a* move from the thread holding position 26B to the feed position 26A and, immediately after that, drive it in the opposite direction, to make the lever 27*c* return to its initial position.

At that time, the thread 11 stretched between the thread feed tube 28*a* and a position close to the needle 10 located in the threading position, by the thread tensioning mechanism 3, is placed on the balance 41 and the auxiliary balance 42 of the balance mechanism 4, with a swing of the auxiliary balance 42, and the end of the thread 11 gripped by the thread gripping member 31 is stretched between the thread gripping member 31 and the thread stretching mechanism 63. In this state, drive the drive mechanism 62*c* of the thread pull-out mechanism 61 and the drive mechanism 72 of the needle supporting mechanism 7, to place and stretch the thread 11 about horizontally on the hooking member 61*a* of the thread pull-out mechanism 61 inserted in the needle hole 10*a* of the needle 10 supported by the needle supporting member 71.

After inserting the hooking member 61*a* of the thread pull-out mechanism 61 in the needle hole 10*a* of the needle 10, make the needle supporting member 71 retreat to return to its initial position, by driving the drive mechanism 72 of the needle supporting mechanism 7 before stretching the thread 11.

And, in the state in which the end of the thread 11 is stretched about horizontally on the hooking member 61*a* of the thread pull-out mechanism 61 inserted in the needle hole 10*a* of the needle 10, drive the drive lever 62*b* with the drive mechanism 62*c*, to make the thread pull-out mechanism 61 retreat and perform threading, by extracting the hooking member 61*a*, while hooking the thread 11 on the hooking member 61*a* of the thread pull-out mechanism 61 formed in the shape of a hook at the tip, to start embroidery work.

After that, drive the belt 35 of the thread tensioning mechanism 3, to make the thread gripping member 31 return to the standby position near the middle position.

Furthermore, the processing in case of breakage of thread 11 can be made not only automatically, but also manually.

In that case, by constructing and utilizing the drive mechanism 62*c* of the thread pull-out mechanism 61 and the drive mechanism 72 of the needle support mechanism 7 in a way to be driven independently for each sewing machine head 1 of the embroidery machine, it becomes possible to perform the processing in case of breakage of thread 11 smoothly, further improving the operating rate and productivity of the sewing machine.

To be concrete, place the broken thread 11 on the balance 41 and the auxiliary balance 42 of the balance mechanism 4 by holding it between your fingers, and drive the drive mechanism 62*c* of the thread pull-out mechanism 61 and the drive mechanism 72 of the needle support mechanism 7. More preferably, construct in a way to automatically drive the drive mechanism 62*c* of the thread pull-out mechanism 61 and the drive mechanism 72 of the needle support mechanism 7, to insert the hooking member 61*a* of the thread pull-out mechanism 61 at the sewing machine head 1 where the thread 11 is broken in the needle hole 10*a* of the needle 10 supported by the needle supporting member 71, and temporarily fasten the end of the thread 11 on the hooking member 61*a* of the thread pull-out mechanism 61 inserted in the needle hole 10*a* of the needle 10, by utilizing the guide pieces 61*d*, 61*d* disposed on both sides of the hooking member 61*a* and the projection 61*e* formed on the guide piece 61*d* on one side, to stretch the thread 11 about horizontally.

After inserting the hooking member 61*a* of the thread pull-out mechanism 61 in the needle hole 10*a* of the needle 10, make the needle supporting member 71 retreat to return to its initial position, by driving the drive mechanism 72 of the needle support mechanism 7, before stretching the thread 11.

And, in the state in which the end of the thread 11 is stretched about horizontally on the hooking member 61*a* of the thread pull-out mechanism 61 inserted in the needle hole 10*a* of the needle 10, drive the drive lever 62*b* with the drive mechanism 62*c*, to make the thread pull-out mechanism 61 retreat and perform threading by extracting the hooking member 61*a* from the needle hole 10*a*, while hooking the thread 11 on the hooking member 61*a* of the thread pull-out mechanism 61 formed in the shape of a hook at the tip.

By the way, while, in the above-described embodiment, the needle support mechanism 7 was constructed in a way to support the needle 10 by swinging in about a horizontal plane from the standby position, it may also be constructed in a way to support the needle 10 by swinging in about a vertical plane from the standby position, as in the embodiment indicated in FIG. 30~FIG. 33.

As described above, by constructing the needle support mechanism 7 in a way to support the needle 10 by swinging in about a vertical plane from the standby position, it becomes possible to reduce the width of the needle support mechanism and thus realize a compact structure of the embroidery machinery including needle support mechanism.

Figure 30:
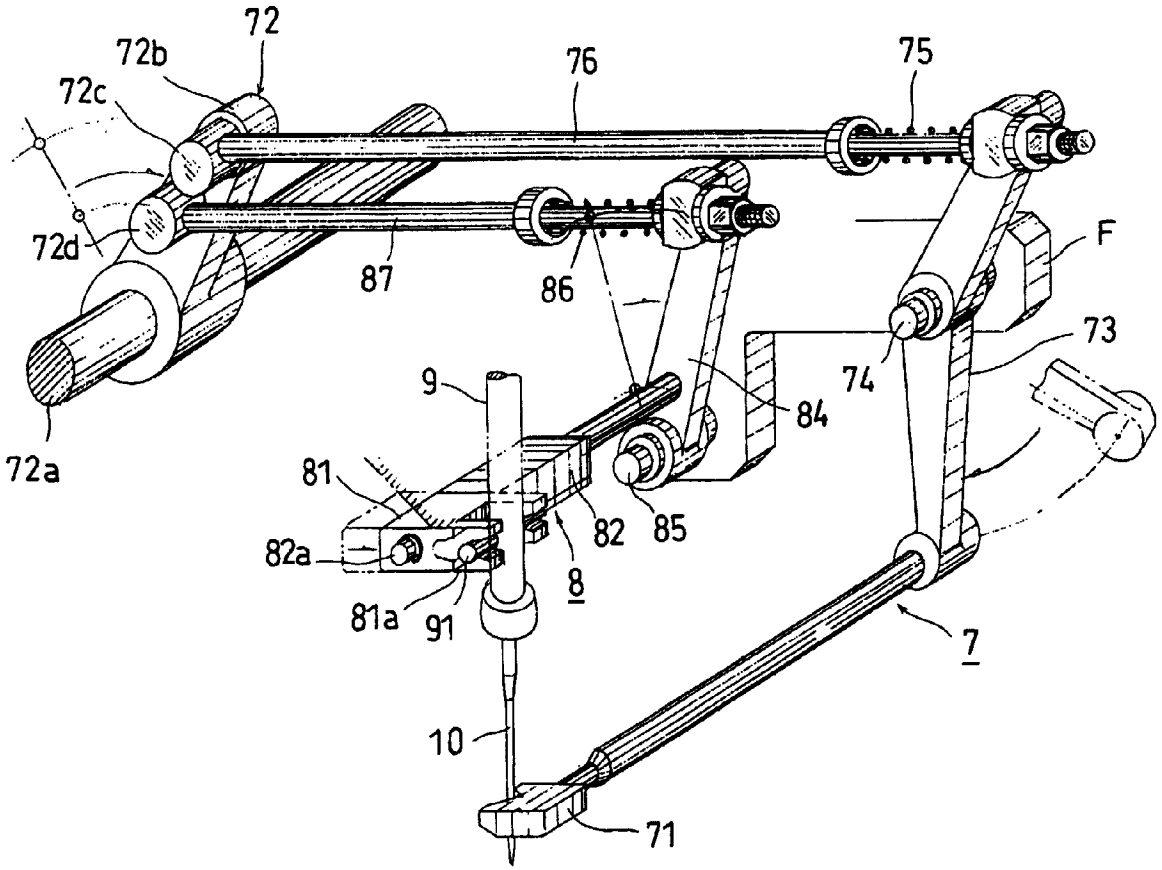
FIG. 30 is an appearance perspective view of the modified embodiment of the needle support mechanism and the needle bar support mechanism.
Figure 31:
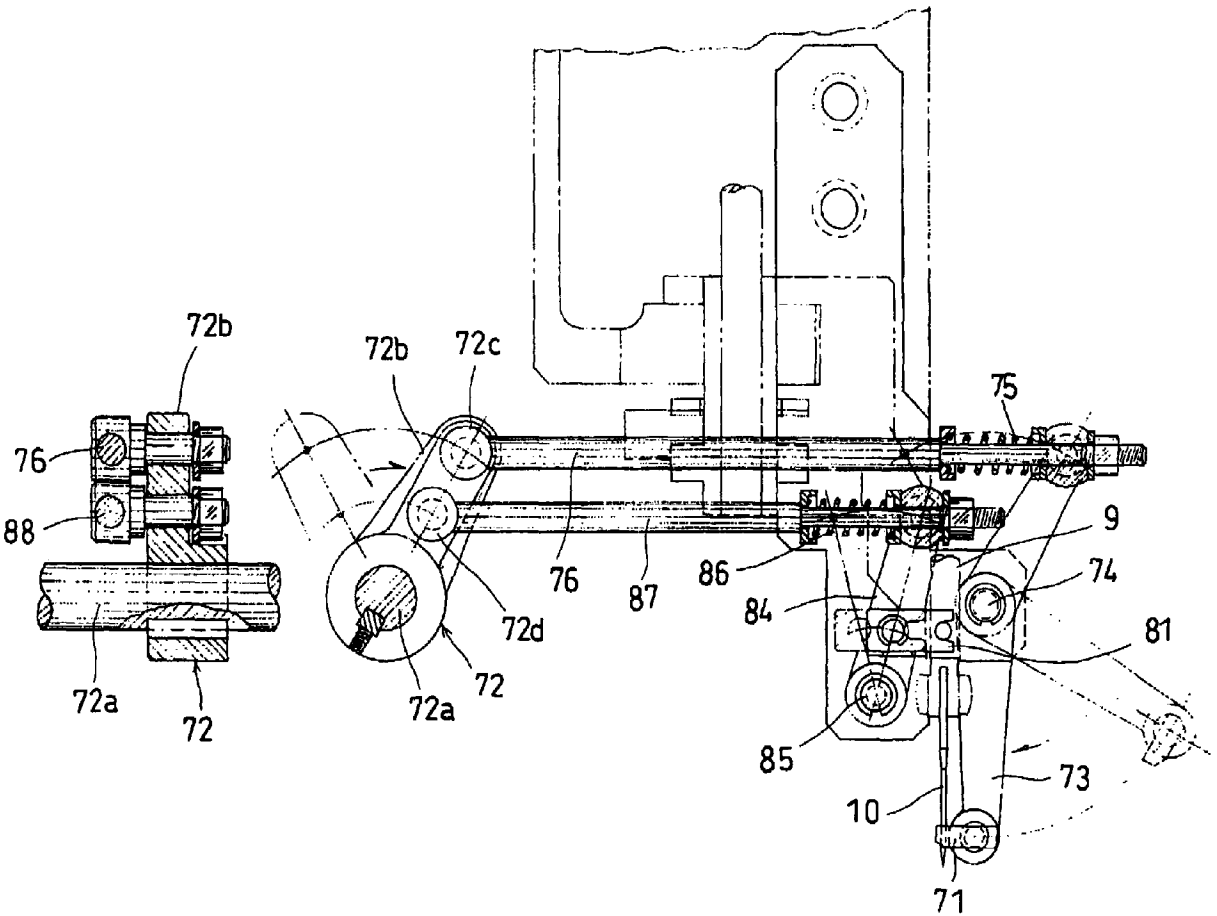
FIG. 31 (A) is a front elevation of the needle support mechanism and the needle bar support mechanism, and (B) a sectional view of the needle support mechanism and the needle bar support mechanism.
Figure 32:
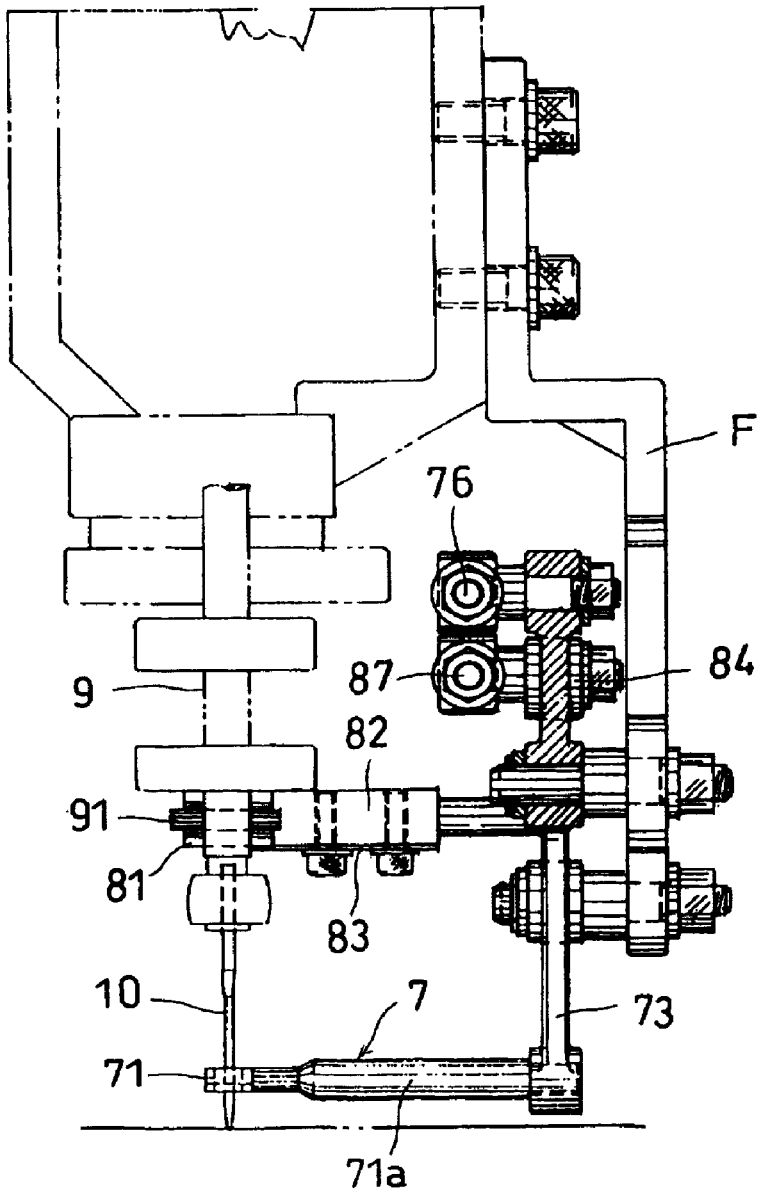
FIG. 32 is a side view of the needle support mechanism and the needle bar support mechanism.
Figure 33:
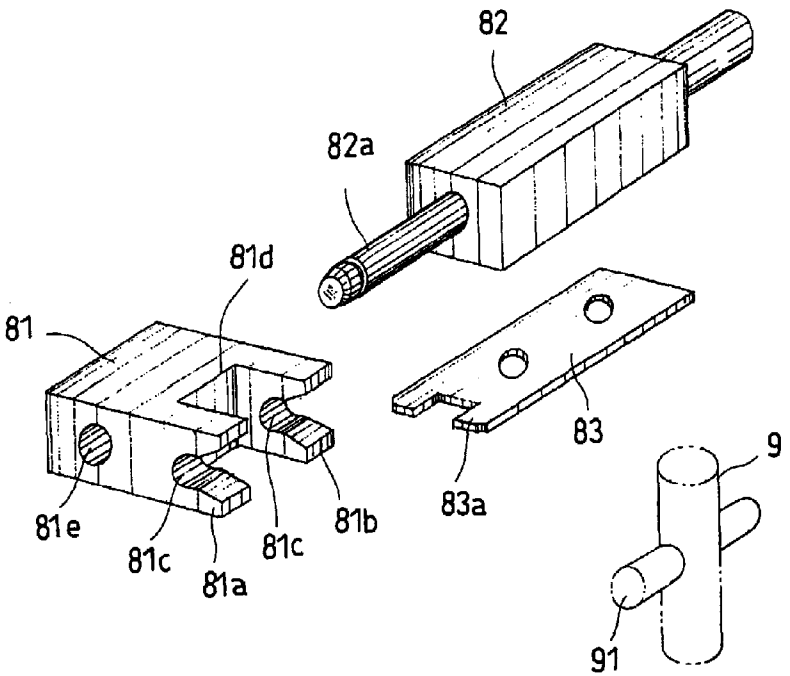
FIG. 33 is an exploded perspective view of the needle support mechanism.

The needle support mechanism 7 in this embodiment is constructed with a needle support member 71 the tip of which is formed in about V shape, and a drive mechanism 72 for swinging the needle support member 71, through a lever 73 and a rod 76 mounted on the base end side of the needle support member 71, so that it may support the needle 10 by swinging it in about a vertical plane with a spindle 74, as shown in FIG. 30~FIG. 32.

In that case, the rod 76 is constructed slidably by using a double tube, by disposing a cushioning spring 75 urging in the direction of extension of the rod 76, and in a way to be supported on the base end side, through a mounting fixture 72*c*, on a swing arm 72*b* mounted on the rotary shaft 72*a* of the drive mechanism 72.

By the way, in this embodiment, a needle bar support mechanism 8 is disposed, in addition to the needle support mechanism 7, movably at a position above the hooking member 61*a* of the thread pull-out mechanism 61, for correcting deflection in the direction of height of the needle bar 9, and position the needle bar 9 in the prescribed position, to thereby correct deflection of the needle 10, through the needle bar 9, when inserting the hooking member 61*a* of the thread pull-out mechanism 61 in the needle hole 10*a*.

This needle bar support mechanism 8 is composed of a needle bar supporting member 81 formed in about a V shape like a fork at the tip, a supporting block 82 on which is to mount the base end side of the needle bar supporting member 81, and a drive mechanism 72 common to the needle support mechanism 7 swinging the needle bar supporting member 81, through a lever 84 and a rod 87, so that it may grip the needle bar 9 and the guide 91 provided in projection in horizontal direction on the needle bar 9 by swinging in about a vertical plane through a spindle 85 mounted on a frame F.

In that case, the rod 87 is constructed slidably by using the double tube, by disposing a cushioning spring 86 urging in the direction of extension of the rod 87, and in a way to be supported at the base end, through a mounting fixture 72*d*, on a swing arm 72*b* mounted on the rotary shaft 72*a* of the drive mechanism 72.

The needle bar supporting member 81 of the needle bar support mechanism 8 forms, by being formed in the shape of a fork 81*a*, 81*b*, a groove 81*d* about in a U shape so that the needle bar 9 may get in there, and is formed in about a V shape 81*c* at the tip so that the guide 91 provided in projection in horizontal direction on the needle bar 9 may get in there.

Moreover, the needle bar supporting member 81 is swingably supported on the supporting block 82, by passing the shaft 82*a* provided in projection on the supporting block 82 through the hole 81*e* drilled in horizontal direction in the needle bar supporting member 81 and filling a snap ring at the tip of the shaft 82*a* for protection against falling.

In that case, to control the amount of swinging of the needle bar supporting member 81, the needle bar supporting member 81 is supported at the bottom face with the tip piece 83*a* of the spring plate 83 provided on the bottom face of the supporting block 82.

While, in this embodiment, the needle support mechanism 7 and the needle bar support mechanism 8 are constructed in such a way that they can be driven simultaneously, by adopting a common drive mechanism for the needle support mechanism 7 and the needle bar support mechanism 8, the needle support mechanism 7 and the needle bar support mechanism 8 may also be constructed in such a way that they can be driven either simultaneously or individually by individual drive mechanisms.

Also in this case, however, it is so arranged that, after the hooking member 61*a* of the thread pull-out mechanism 61 is inserted in the needle hole 10*a* of the needle 10, the needle supporting member 71 is made to retreat to return to its initial position, by driving the drive mechanism of the needle bar support mechanism 8, before the thread 11 is stretched.

And, by disposing, as in this embodiment, the needle bar support mechanism 8 in addition to the needle support mechanism 7, it becomes possible to correct deflection in the direction of height of the needle bar 9 when inserting the hooking member 61*a* of the thread pull-out mechanism 61 of the threading mechanism 6 in the needle hole 10*a*, also correct deflection in the transversal direction at the same time, in the construction of this embodiment, hook the end of the thread 11, led to a position close to the needle 10 in the state gripped by the thread gripping member 31, with the in the needle hole 10*a*, by hooking the needle 10 by means of hooking member 61*a* formed in the shape of a hook at the tip, and pass it through the needle hole 10*a*. In addition, it also becomes possible to prevent deflection of the needle 10 when inserting the hooking member 61*a* in the needle hole 10*a*, and insert the hooking member 61*a* in the needle hole 10*a* smoothly, to ensure accurate threading.

The drive mechanism 72 of the needle support mechanism 7 and the needle bar support mechanism 8 may be constructed independently for each sewing machine head 1 of the embroidery machine in a way to be capable of individual driving, to thereby make it possible to perform all processing relating to all the threads 11 including processing in case of breakage of thread 11 automatically, and make the thread pull-out mechanism 61 available for use also when performing the processing in case of breakage of thread 11 manually, further improving the operating rate and productivity of the sewing machine.

Figure 34:
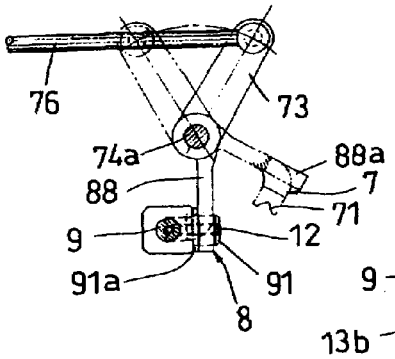
FIGS. 34(A)–34(C) indicate a modified embodiment of the needle support mechanism and the needle bar support mechanism, (A) being a front elevation, (B) a plan view, and (C) a side sectional view.
Figure 34:
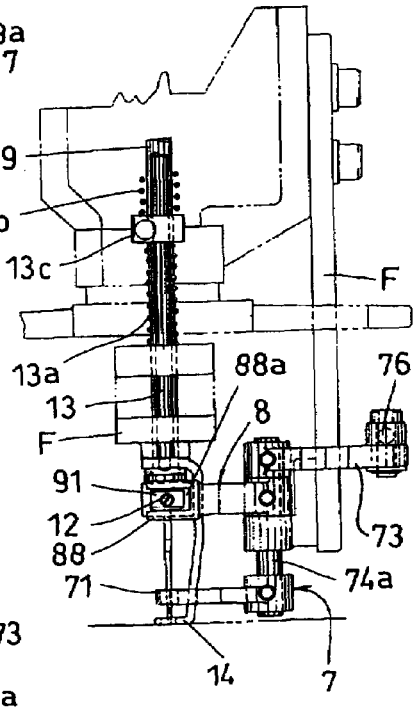
Figure 34:
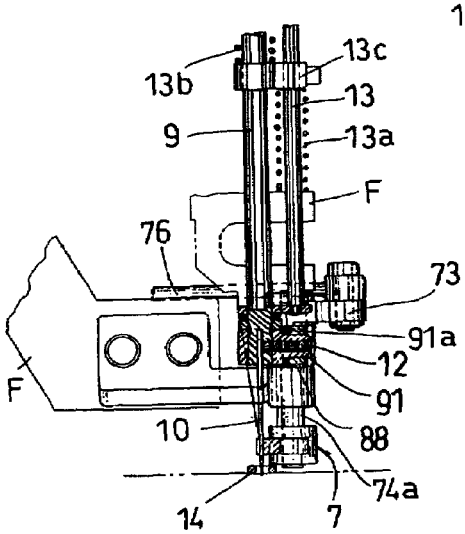

Furthermore, the needle bar support mechanism 8 may also be constructed, in addition to above, in a way to fully share the drive mechanism with the needle support mechanism 7, as shown in FIG. 34.

Namely, the needle support mechanism 7 is constructed by comprising a needle supporting member 71 formed in about a V shape at the tip, and a drive mechanism (not illustrated) for swinging the needle supporting member 71, through the lever 73 and the rod 76 mounted on the base end side of the needle supporting member 71, so that it may support the needle 10 by swinging it in about a horizontal plane around the spindle 74*a* mounted on the frame F.

And, the bar support mechanism 8 is constructed with a needle bar supporting member 88 provided with a fitting 88*a* formed in about a U shape to be fit to the guide 91, which shares the axis 74*a* mounted on the frame F and is provided in projection in horizontal direction on the needle bar 9, by swinging in about a horizontal plane around this axis 74*a*.

This guide 91, also having a function of fixing the needle 10, is provided at the center with a screw 12 for fixing the needle 10.

This bar support mechanism 8 is realized in such a way that it swings, in linkage with the needle support mechanism 7, the needle bar supporting member 88 in about a horizontal plane around the axis 74*a* mounted on the frame F to fit the fitting 88*a* of the needle bar supporting member 88 to the guide 91 provided in projection in horizontal direction on the needle bar 9, for correcting deflection in the direction of height of the bar 9 and positioning the needle bar 9 in prescribed position, so as to correct deflection in the direction of height of the needle 10 when inserting the hooking member 61*a* of the thread pull-out mechanism 61 in the needle hole 10*a*, through the needle bar 9.

And, in this embodiment, chamfering is made to the tip face of the guide 91, to make it easier to fit the fitting 88*a* of the needle bar supporting member 88 to the guide 91 provided in projection in horizontal direction on the needle bar 9, and a pad 91*a* made of rubber, urethane, etc. is disposed at the base of the guide 91, for absorbing shocks produced when the fitting 88*a* of the needle bar supporting member 88 is fit to the guide 91 provided in projection in horizontal direction on the needle bar 9.

Still more, to prevent the needle bar 9 from turning or deflecting in the transversal direction, a guide bar 13 is provided, in parallel with the needle bar 9, in a way to be slidable relatively against the needle bar 9, through a retaining member 13*c* fixed to the frame F and the guide bar 13, and at the bottom end of this guide bar 13 is formed a cloth presser 14 and are disposed springs 13*a*, 13*b* for urging it.

Figure 35:
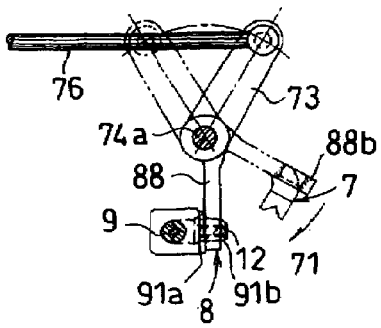
FIGS. 35(A)–35(C) indicate a modified embodiment of the needle support mechanism and the needle bar support mechanism, (A) being a front elevation, (B) a plan view, and (C) a side sectional view.
Figure 35:
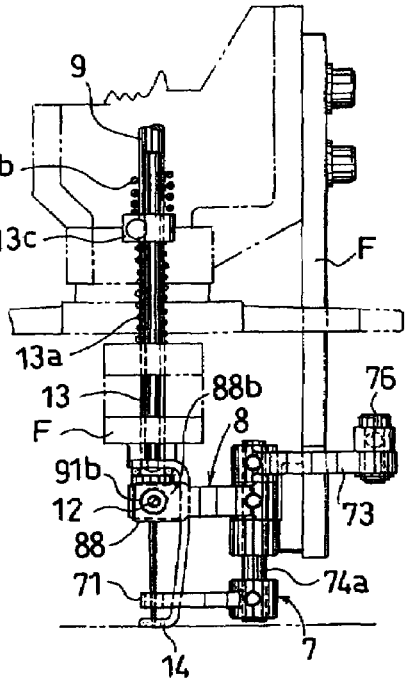
Figure 35:
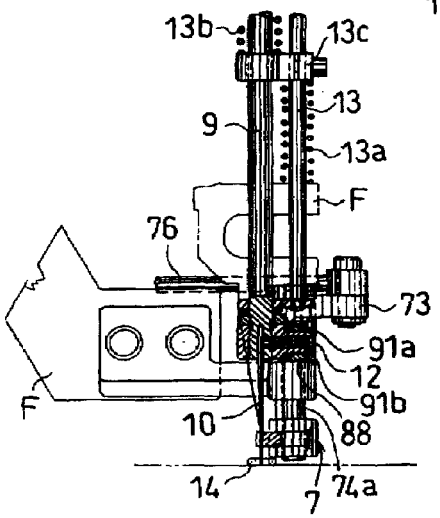
Figure 36:
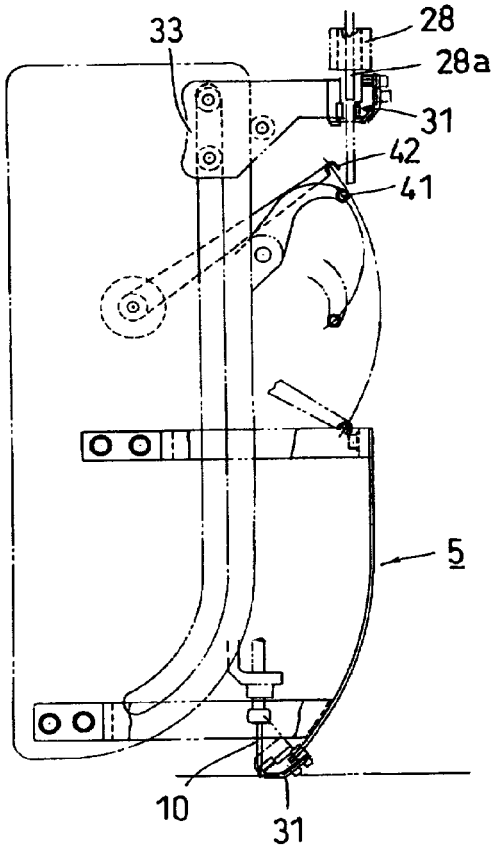
FIGS. 36(A) and 36(B) indicate a modified embodiment of the threading mechanism, (A) being a side view, and (B) a front elevation.
Figure 36:
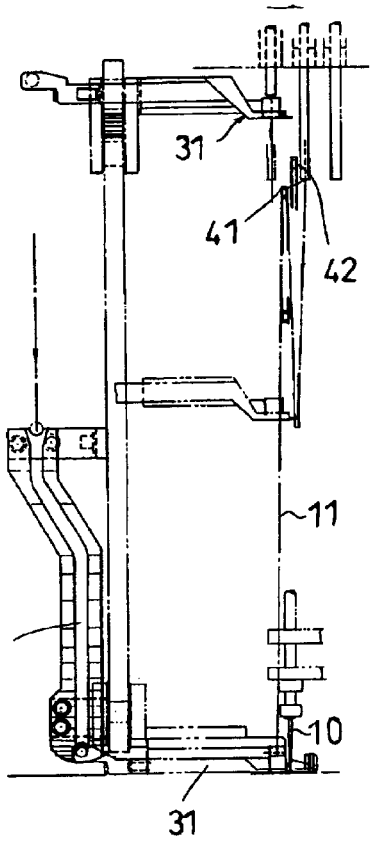
Figure 37:
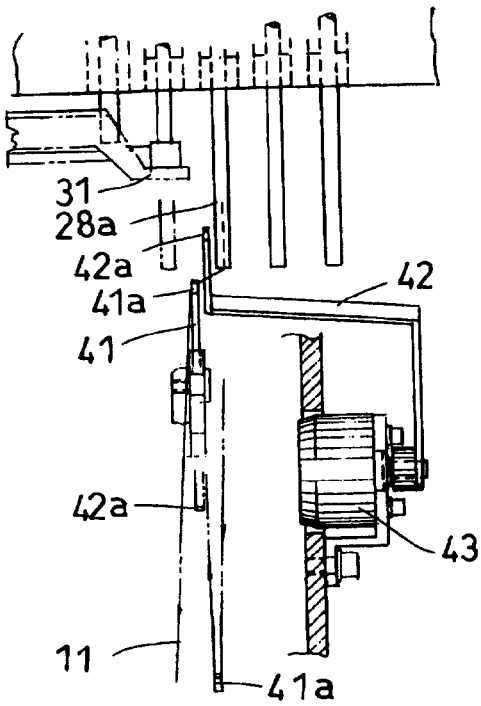
FIGS. 37(A) and 37(B) indicate a modified embodiment of the balancing mechanism, (A) being a front elevation, and (B) a side view.
Figure 37:
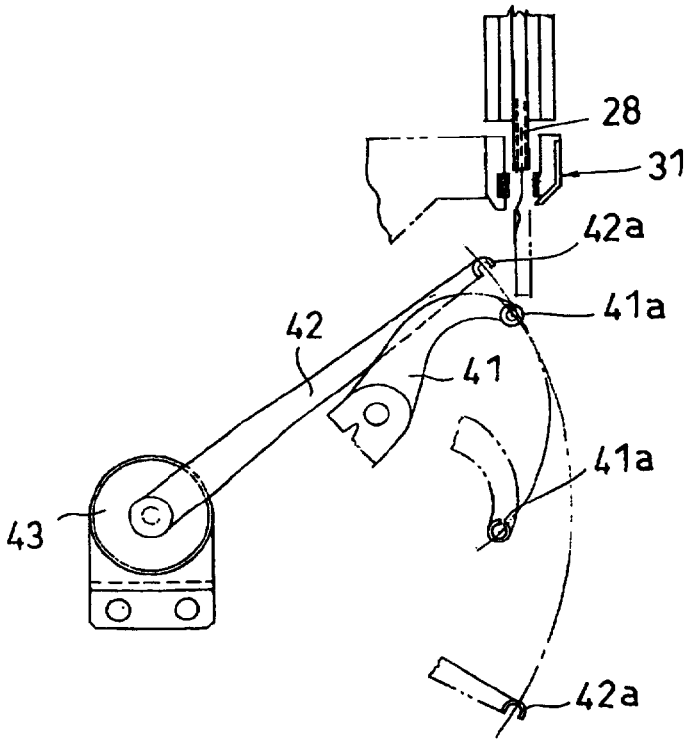

Yet more, while, in the embodiment indicated in FIG. 34, the bar support mechanism 8 is constructed with a needle bar supporting member 88 provided with a fitting 88*a* formed in about a U shape to be fit to the guide 91, which shares the axis 74*a* mounted on the frame F and is provided in projection in horizontal direction on the needle bar 9, by swinging in about a horizontal plane around this axis 74*a*, the bar support mechanism 8 may also be constructed, in addition to above, with a needle bar supporting member 88 provided with a fitting 88*b* formed in about a circular hole to be fit to the guide 91*b*, which shares the axis 74*a* mounted on the frame F and is provided in projection in horizontal direction on the needle bar 9 by swinging in about a horizontal plane around this axis 74*a*, as in the modified embodiment indicated in FIG. 35.

As described above, by forming fitting 88*b* in about a circular hole, it becomes possible to correct deflection in transversal direction, in addition to deflection in the direction of height, of the bar 9 and positioning the needle bar 9 in prescribed position, so as to correct deflection of the needle 10 when inserting the hooking member 61*a* of the thread pull-out mechanism 61 in the needle hole 10*a*, through the needle bar 9 more accurately.

And, also in this embodiment, chamfering is made to the tip face of the guide 91*b*, to make it easier to fit the fitting 88*b* of the needle bar supporting member 88 to the guide 91*b* provided in projection in horizontal direction on the needle bar 9, and a pad 91*a* made of rubber, urethane, etc. is disposed at the base of the guide 91*b*, for absorbing shocks produced when the fitting 88*b* of the needle bar supporting member 88 is fit to the guide 91*b* provided in projection in horizontal direction on the needle bar 9.

Explanation has so far been given of the threading device for embroidery machinery according to the present invention, based on an embodiment applied to an embroidery machine capable of performing the processing for change of colored thread automatically without intervention of an operator. However, the mechanisms constituting the threading device for embroidery machinery according to the present invention are not restricted to above, but may also be applicable to general embroidery machinery.

Moreover, the mechanisms constituting the threading device for embroidery machinery according to the present invention are not restricted to those of the construction indicated in the embodiment, but their construction may be modified as required within the scope not deviating from its purpose.

For example, instead of driving the auxiliary balance 42 of the balancing mechanism 4 with the drive mechanism 36 of the thread tensioning mechanism 3 in linkage with the thread gripping member 31, the threading device 5 for embroidery machinery may be constructed in a way to swing the auxiliary balance 42 with a drive mechanism 43, by providing an independent drive mechanism 43 for the auxiliary balance 42 of the balancing mechanism 4, such as electric motor, solenoid, etc., as shown in FIG. 36(A)~FIG. 38, to place the thread 11 in the threading hole 41*a* formed at the tip of the balance 41 and the threading hole 42*a* formed at the tip of the auxiliary balance 42.

In that case, it is preferable to provide a locking member 41*b* made of an elastic member such as piano wire, etc. for sealing the notch of the threading hole 41*a*, to prevent the thread 11 once placed in the threading hole 42*a* formed at the tip of the balance 41 and the auxiliary balance 42 from falling off the threading holes 41*a*, 42*a*, or provide a locking member 42*i* for sealing the notch of the threading hole 42*a* at the position of bottom dead center of the auxiliary balance 42, for example.

Figure 38:
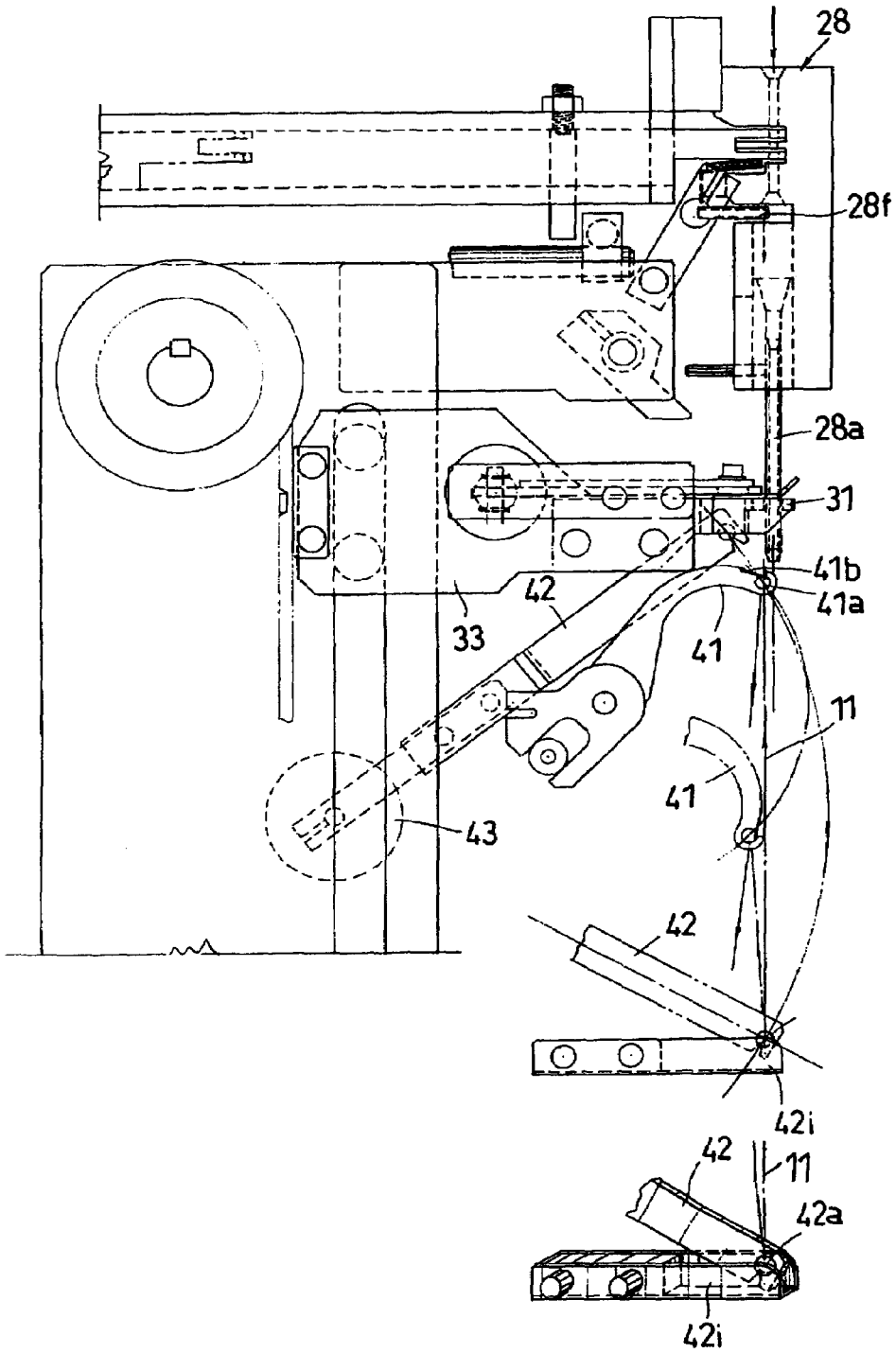
FIG. 38 is a side view showing a modified embodiment of the threading mechanism and the balancing mechanism.
Figure 39:
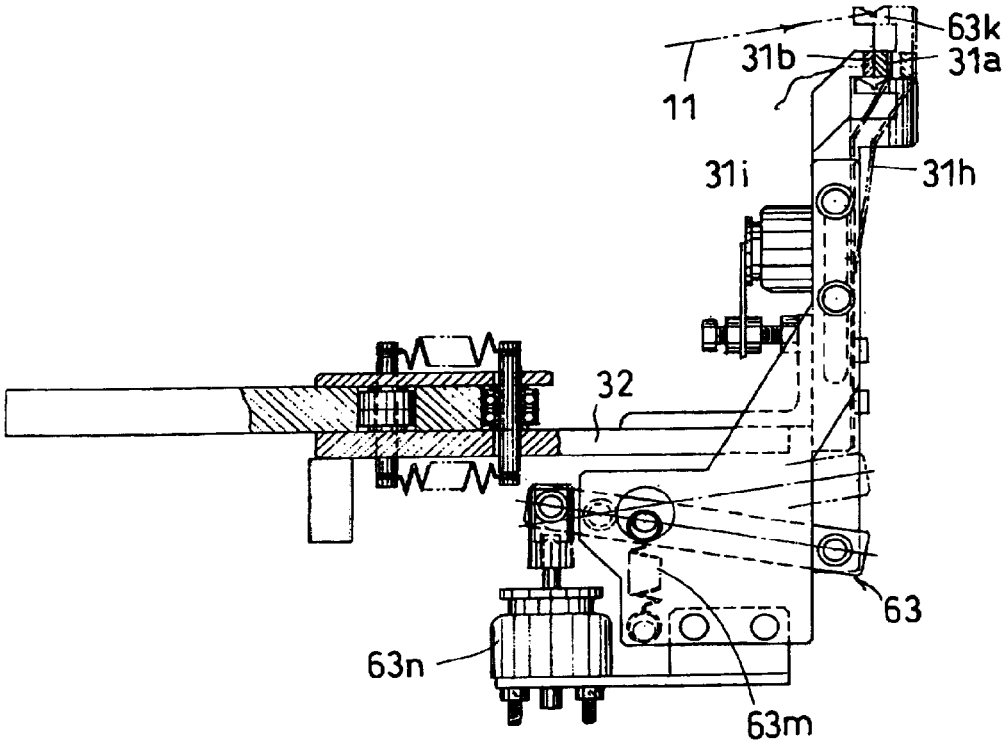
FIGS. 39(A) and 39(B) indicate the thread gripping member of the thread tensioning mechanism and the thread stretching mechanism of the threading mechanism, (A) being a plan view, and (B) a side sectional view.
Figure 39:
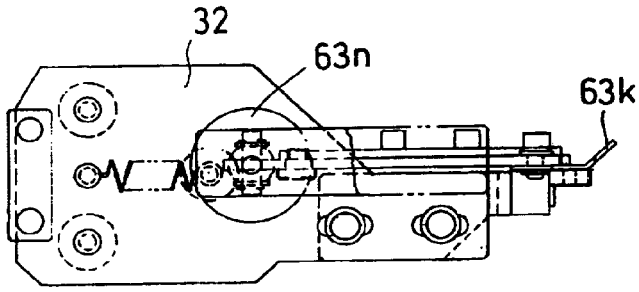

Furthermore, as shown in FIG. 38, an air jet nozzle 28*f* connected to an air source (not illustrated) may be disposed, on the thread feed mechanism 28, toward the direction of delivery of the thread 11, so that the thread 11 inserted in the thread feed tube 28*a* of the thread feed mechanism 28 may hang vertically from the thread feed tube 28*a* without being entangled and is sent out smoothly from the thread feed mechanism 28 toward the needle 10.

Still more, the drive mechanism for the mobile gripping piece 31*a* of the thread gripping member 31 may be constructed, as shown in FIG. 38, with a sheet spring 31*h* for gripping the thread 11 between the mobile gripping piece 31*a* and the fixed gripping piece 31*b*, and a solenoid, mounted directly on the thread gripping member 31, for releasing the mobile gripping piece 31*a* against the urging force of the sheet spring 31*h*.

Yet more, the thread stretching mechanism 63 may be constructed, as shown in FIG. 38, with a sliding member 63*k*, mounted in a way to be slidable on the thread gripping member 31, a spring member 63*m* for urging the sliding member 63*k* in the storing direction, and a solenoid 63*n*, mounted directly on the thread gripping member 31, for stretching the threads 11 about horizontally, in the space formed with the thread gripping member 31, by sliding the sliding member 63*k* against the urging force of the spring member 63*m*.

Next, explanation will be made on the operating method for starting an embroidery work with the embroidery machine of the modified embodiment indicated in FIG. 36(A)~FIG. 39(B), with reference to FIG. 40~FIG. 41.

By driving the thread selecting mechanism 29, slide the thread tension regulating mechanism 24, and position the thread feed tube 28*a* of the thread feed mechanism 28 corresponding to the prescribed bobbins 21, selectively and accurately, over the threading device 5 which performs threading.

At that time, also drive the drive mechanism 62*c* of the thread pull-out mechanism 61, the needle support mechanism 7 and the needle bar support mechanism 8 simultaneously, to support the needle 10 with the needle supporting member 71 and the needle supporting member 81, and to insert the hooking member 61*a* of the thread pull-out mechanism 61 in the needle hole 10*a*.

After that, drive the belt 35 of the thread tensioning mechanism 3, to make the thread gripping member 31 of the thread tensioning mechanism 3 move from the standby position (① in FIG. 40) at about the middle part (right under the lowest position of the auxiliary balance 42 of the balance mechanism 4) to the highest position where to grip the end of the thread 11 hanging from the thread feed tube 28*a*. At the same time, drive the thread length regulating mechanism 26, to hold the threads 11 delivered toward the needle 10 at prescribed length or, to be concrete, by a length at which the thread 11 of the length required for being placed on the balance 41 and the auxiliary balance 42 may be delivered (② in FIG. 40).

At that time, release the mobile gripping piece 31*a* of the thread gripping member 31 against the urging force of the sheet spring 31*h*, with the solenoid 31*h*.

And, in the state in which the thread feed tube 28*a* is positioned between the mobile gripping piece 31*a* and the fixed gripping piece 31*b* of the thread gripping member 31 in the thread tensioning mechanism 3 of the threading device 5, drive the drive mechanism 28*e* of the operating lever 28*d*, to operate the operating piece 28*c* of the thread feed tube 28*a* with the operating lever 28*d*, so as to make the thread feed tube 28*a* go up and expose the threads 11. Blow out air toward the direction of delivery of the thread 11 from the air jet nozzle 28*f*, so that the thread 11 may hang vertically from the thread feed tube 28*a* without being entangled and, in that state, release the solenoid 31*h*, to hold the end of the threads 11 with the mobile gripping piece 31*a* and the fixed gripping piece 31*b* of the thread gripping member 31 in the thread tensioning mechanism 3 of the threading device 5, and then stop blowing out of air from the air jet nozzle 28*f* (③ in FIG. 40).

Figure 40:
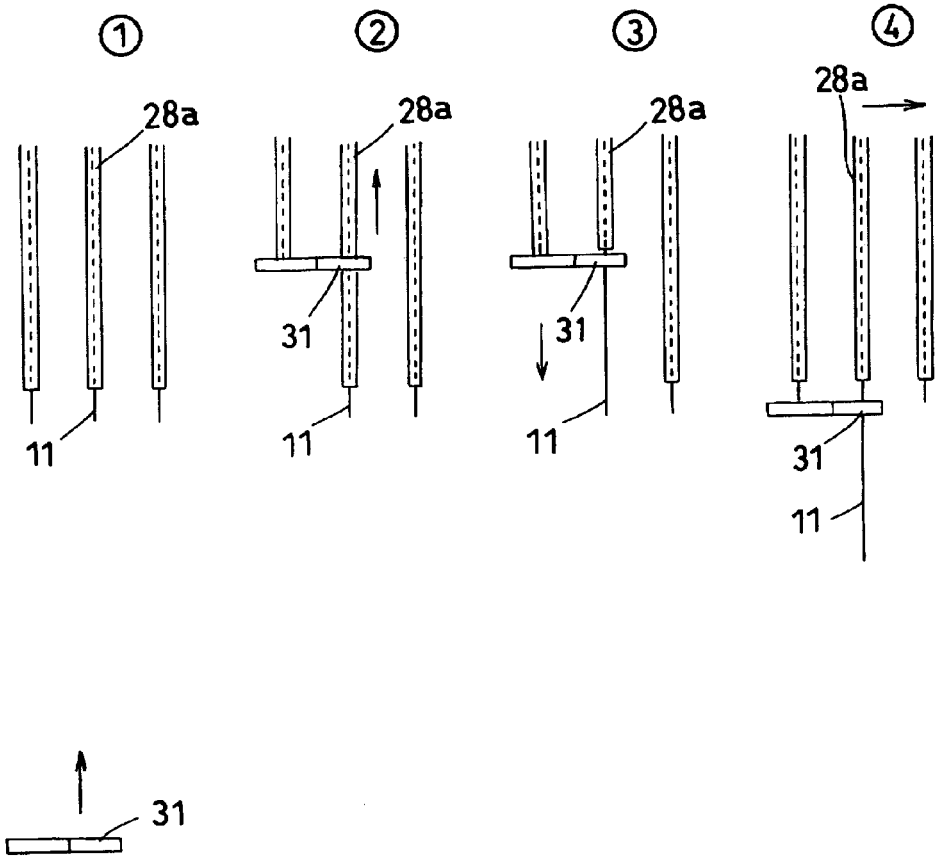
FIG. 40 is an explanatory drawing (1) showing motions of an embroidery machine.

And, once drive the belt 35 of the thread tensioning mechanism 3, to let down the thread gripping member 31 of the thread tensioning mechanism 3, and also let down the thread feed tube 28*a* which has been made to go up (④ in FIG. 40).

Figure 41:
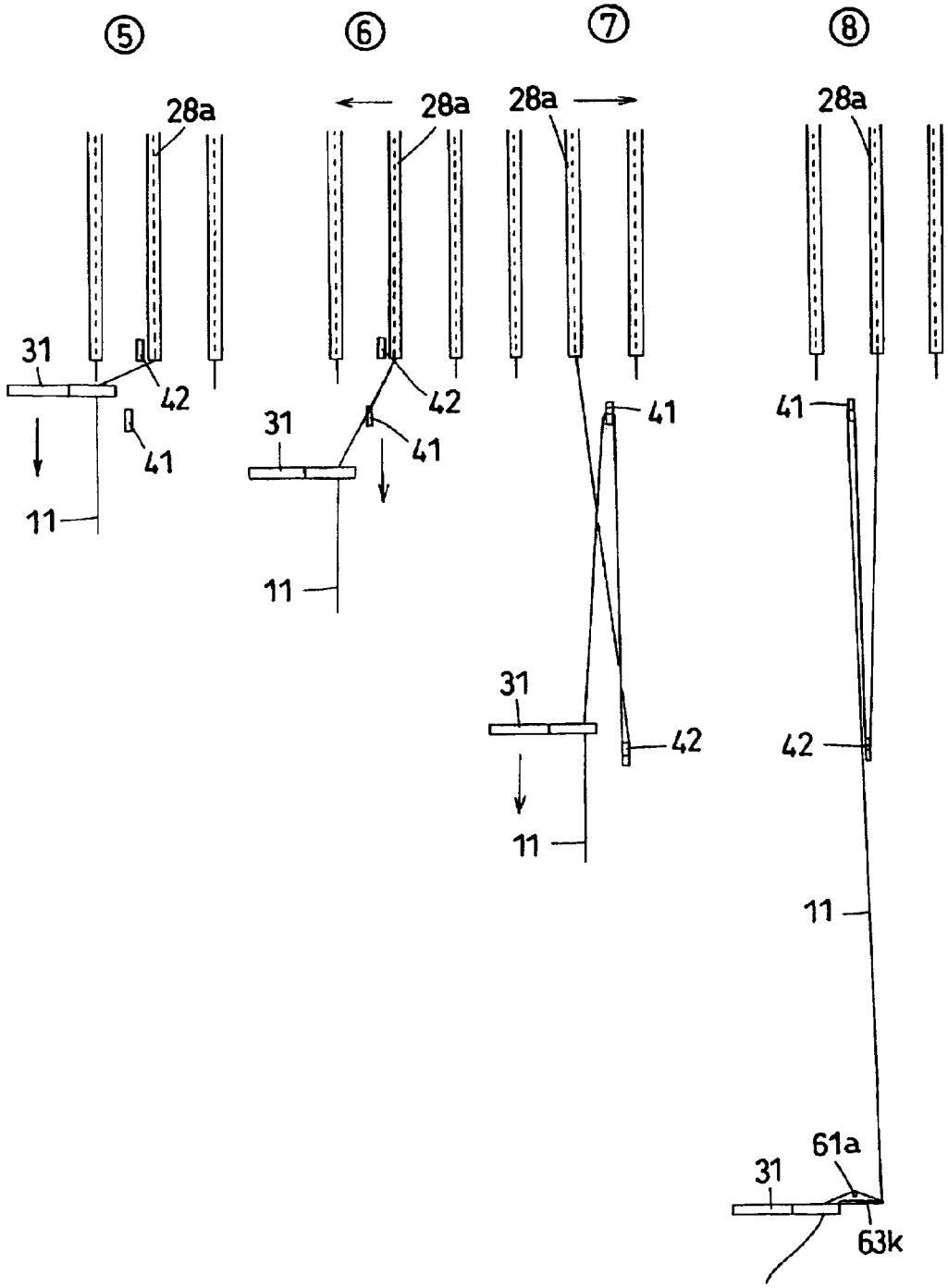
FIG. 41 is an explanatory drawing (2) showing motions of an embroidery machine.

And, drive the thread selecting mechanism 29 of the thread feeder 2, to make the thread feed tube 28*a* move sideways (to the right) by a step in the state where the thread 11 is stretched (⑤ in FIG. 41).

In that state, drive the belt 35 of the thread tensioning mechanism 3, to make the thread gripping member 31 of the thread tensioning mechanism 3 move to about the middle part (right under the lowest position of the auxiliary balance 42 of the balance mechanism 4), and drive the drive mechanism 43 of the auxiliary balance 42 with, such as electric motor, rotary solenoid, etc., to make the auxiliary balance 42 move to its lowest position and place the thread 11 on the balance 41 and the auxiliary balance 42. At the same time, drive the thread selecting mechanism 29 of the thread feeder 2, to make the thread feed tube 28*a* move sideways (left side) by a step in the state where the threads 11 are placed, and drive the thread length regulating mechanism 26, so that the threads 11 may be delivered by prescribed length or, to be concrete, by a length required for being placed on the needle 10 (⑥,⑦ in FIG. 41). The sequence of movement of the thread gripping member 31 and the auxiliary balance 42 and of start of driving of the thread selecting mechanism 29 is decided in a way to secure a certain time difference as required, so that the threads 11 may be placed accurately on the balance 41 and the auxiliary balance 42.

And, drive the belt 35 of the thread tensioning mechanism 3, to further let down the thread gripping member 31 of the thread tensioning mechanism 3, to stretch the thread 11 gripped by the thread gripping member 31 between the thread gripping member 31 and the thread stretching mechanism 63. In that state, drive the drive mechanism 62*c* of the thread pull-out mechanism 61 as well as the needle support mechanism 7 and the needle bar support mechanism 8 in advance, to place (the thread 11) on the hooking member 61*a* of the thread pull-out mechanism 61 inserted in the needle hole 10*a* of the needle 10 supported by the needle bar supporting member 71 and the needle bar supporting member 81. And further drive the thread selecting mechanism 29 of the thread feeder 2, to make the thread feed tube 28*a* move sideways (right side) by a step in the state in which the thread 11 is placed (⑧ in FIG. 41).

And, in the state in which the end of the thread 11 is stretched about horizontally on the hooking member 61*a* of the thread pull-out mechanism 61 inserted in the needle hole 10*a*, drive the drive lever 62*b* with the drive mechanism 62*c*, to make the thread pull-out mechanism 61 retreat. At the same time, release the mobile gripping piece 31*a* of the thread gripping member 31 against the urging force of the sheet spring 31*h*, with the solenoid, to release the thread 111 which has been gripped by the thread gripping member 31 and, while hooking the thread 11 on the hooking member 61*a* of the thread pull-out mechanism 61 formed in the shape of a hook at the tip, perform threading by extracting the hooking member 61*a* from the needle hole 10*a*, to start embroidery work.

After that, drive the belt 35 of the thread tensioning mechanism 3, to make the thread gripping member 31 return to the standby position near the middle position.

Other operating methods and actions of the embroidery machine of this modified embodiment are the same as those of the embroidery machine in the embodiment.

INDUSTRIAL APPLICABILITY

According to the threading device for embroidery machinery of the present invention, the threading mechanism of which comprises a thread pull-out mechanism provided with a needle support mechanism formed in the shape of a hook at the tip, this thread pull-out mechanism being disposed movably facing the hooking member, for preventing deflection of the needle, by correcting deflection of the needle, when inserting the hooking member in the needle hole, it becomes possible to pass the end of the thread, led to a position close to the needle in the state gripped by the thread gripping member, in the needle hole, by hooking the needle by means of a hooking member formed in the shape of a hook at the tip. It also becomes possible to prevent deflection of the needle when inserting the hooking member in the needle hole, so as to insert the hooking member in the needle hole smoothly and perform threading accurately.

The invention claimed is:

1. A threading device for embroidery machinery, the threading device comprising:

a thread pull-out mechanism having a hooking member formed in the shape of a hook at a tip of the thread pull-out mechanism; and a needle support mechanism disposed movably facing the hooking member, the needle support mechanism for preventing needle deflection by correcting deflection of a needle when inserting the hooking member in a hole in the needle.

2. A threading device for embroidery machinery as defined in claim 1, wherein the needle support mechanism supports the needle by swinging about in a horizontal plane from a standby position.

3. A threading device for embroidery machinery as defined in claim 1, wherein the needle support mechanism supports the needle by swinging about in a vertical plane from a standby position.

4. A threading device for embroidery machinery as defined in claim 1, wherein the needle support mechanism has a needle support member, and a tip of the needle support member is formed in a V shape.

5. A threading device for embroidery machinery as defined in claim 1, wherein the thread pull-out mechanism and the needle support mechanism each have a drive mechanism, and if a thread breaks, the drive mechanism of the thread pull-out mechanism and the drive mechanism of the needle support mechanism have the hooking member inserted into the hole of the needle supported by the needle support mechanism, the drive mechanism of the needle support mechanism makes the needle support mechanism retreat to a standby position, and the drive mechanism of the thread pull-out mechanism then makes the thread pull-out mechanism return to perform threading, whereby the thread is stretched on the hooking member of the thread pull-out mechanism.

6. A threading device for embroidery machinery as defined in claim 5, wherein the hooking member of the thread pull-out mechanism is automatically inserted into the hole of the needle supported by the needle support mechanism by at least minimally driving the drive mechanism of the thread pull-out mechanism and the drive mechanism of the needle support mechanism, and the needle support member is made to retreat to the standby position, by driving the drive mechanism of the needle supporting mechanism, and remain on standby in the standby position.

7. A threading device for embroidery machinery as defined in claim 1, further comprising guide pieces disposed on both sides of the hooking member of the thread pull-out mechanism, wherein at least one of the guide pieces has a projection formed thereon.

8. A threading device for embroidery machinery , the threading device comprising:

a thread pull-out mechanism having a hooking member formed in the shape of a hook at a tip of the thread pull-out mechanism;

a needle support mechanism disposed movably at a position above the hooking member, the needle support mechanism for positioning a needle in a prescribed position by correcting needle deflection when inserting the hooking member in a hole in the needle;

a needle bar for holding the needle, the needle bar having a guide projecting in a horizontal direction; and a needle bar support mechanism having a needle bar support member to grip the guide, wherein the needle support mechanism has a needle support member, a tip of the needle support member is formed in a forked, V shape to grip the needle, and the needle bar support member grips the guide at the same time as the needle support member grips the needle.

9. A threading device for embroidery machinery ,the threading device comprising:

a thread pullout mechanism having a hooking member formed in the shape of a hook at a tip of the thread pull-out mechanism;

a needle support mechanism disposed movably at a position above the hooking member, the needle support mechanism for positioning a needle in a prescribed position by correcting needle deflection when inserting the hooking member in a hole in the needle;

a needle bar for holding the needle, the needle bar having a guide; and a needle bar support mechanism having a needle bar support member, wherein the needle bar support member fits the guide provided in projection on the needle bar.

10. A threading device for embroidery machinery, the threading device comprising:

a thread pull-out mechanism having a hooking member formed in the shape of a hook at a tip of the thread pull-out mechanism;

a needle support mechanism disposed movably at a position above the hooking member, the needle support mechanism for positioning a needle in a prescribed position by correcting needle deflection when inserting the hooking member in a hole in the needle; and a needle bar support mechanism having a needle bar support member, wherein the needle support mechanism has a drive mechanism, and the needle bar support mechanism is driven in synchronization with the drive mechanism of the needle support mechanism.

11. A threading device for embroidery machinery, the threading device comprising:

a thread tensioning mechanism having a thread gripping member for gripping an end of a thread hanging from a thread feed tube, the thread tensioning mechanism for leading the thread gripped by the thread gripping member to a position close to a needle and placing the thread on a balancing mechanism; and a threading mechanism for guiding the thread into a hole in the needle, the threading mechanism comprising:

a thread pull-out mechanism having a needle supporting mechanism and a hooking member formed in the shape of a hook at a tip of the thread pull-out mechanism; and a thread stretching mechanism movably mounted on the thread gripping member, the thread stretching mechanism for stretching the thread gripped by the thread gripping member horizontally on the hooking member, in a space formed by the thread gripping member.

12. A threading device for embroidery machinery as defined in claim 11, wherein the thread stretching mechanism stretches the thread gripped by the thread gripping member by moving in a horizontal direction in the space formed by the thread tensioning mechanism while getting to a position close to the needle, following the thread gripping mechanism of the thread tensioning mechanism.

13. A threading device for embroidery machinery as defined in claim 11, wherein the thread tensioning mechanism has a drive mechanism operable to move the thread gripping member from the thread feed tube to a position close to the needle slowly at the thread feed tube and at a position close to the needle and quickly in an intermediate position between the thread feed tube and the needle.

14. A threading device for embroidery machinery as defined in claim 11, wherein the needle support mechanism prevents needle deflection by correcting deflection of the needle when inserting the hooking member in the needle hole, and the needle support mechanism is mounted movably facing the hooking member.

15. A threading device for embroidery machinery as defined in claim 11, wherein the thread tensioning mechanism has a drive mechanism and the thread pull-out mechanism and the needle support mechanism have a drive mechanism, and at least one of the drive mechanisms can be driven independently at each sewing machine head of the embroidery machinery.

16. A threading device for embroidery machinery as defined in claim 11, further comprising guide pieces disposed on both sides of the hooking member of the thread pull-out mechanism, wherein at least one of the guide pieces has a projection for temporarily fastening the thread formed thereon.

17. A threading device for embroidery machinery , the threading device comprising:

a thread pull-out mechanism having a hooking member formed in the shape of a hook at a tip of the thread pull-out mechanism;

a needle support mechanism disposed movably at a position above the hooking member, the needle support mechanism for positioning a needle in a prescribed position by correcting needle deflection when inserting the hooking member in a hole in the needle; and guide pieces disposed on both sides of the hooking member of the thread pull-out mechanism, at least one of the guide pieces having a projection formed thereon.

* * * * *